US009157629B2

(12) United States Patent
Brauner et al.

(10) Patent No.: US 9,157,629 B2
(45) Date of Patent: Oct. 13, 2015

(54) ILLUMINATED HAND TOOL ASSEMBLY

(71) Applicant: ReadyMax, Inc., Elk Grove, CA (US)

(72) Inventors: Bill E. Brauner, Angels Camp, CA (US); Eivind Clausen, Bellingham, WA (US); Mickey Makay, San Jose, CA (US)

(73) Assignee: ReadyMax, Inc., Elk Grove, CA (US)

( * ) Notice: Subject to any disclaimer, the term of this patent is extended or adjusted under 35 U.S.C. 154(b) by 0 days.

(21) Appl. No.: 14/201,249

(22) Filed: Mar. 7, 2014

(65) Prior Publication Data

US 2015/0062876 A1 Mar. 5, 2015

Related U.S. Application Data

(60) Provisional application No. 61/871,083, filed on Aug. 28, 2013.

(51) Int. Cl.

| | |
|---|---|
| ***F21V 33/00*** | (2006.01) |
| ***B25B 7/06*** | (2006.01) |
| ***B25B 7/22*** | (2006.01) |
| ***F21L 4/00*** | (2006.01) |

(Continued)

(52) U.S. Cl.

CPC ..... *F21V 33/0084* (2013.01); *B25B 7/06* (2013.01); *B25B 7/08* (2013.01); *B25B 7/10* (2013.01); *B25B 7/22* (2013.01); *F21L 4/00* (2013.01)

(58) Field of Classification Search

CPC ..... B25B 7/22; B25B 7/06; B25B 7/08; B25B 7/10; F25B 23/18; F21V 33/0084

See application file for complete search history.

(56) References Cited

U.S. PATENT DOCUMENTS

| | | | |
|---|---|---|---|
| 2,854,564 | A | 9/1958 | Cohen et al. |
| 4,144,779 | A | 3/1979 | Honick |
| 5,573,329 | A | 11/1996 | van Gennep |

(Continued)

FOREIGN PATENT DOCUMENTS

| | | |
|---|---|---|
| CN | 202137721 | 2/2012 |
| JP | 10-086072 | 4/1998 |

(Continued)

OTHER PUBLICATIONS

International Search Report dated Nov. 5, 2014 from International Application No. PCT/US2014/052872.

(Continued)

*Primary Examiner* — Leonard Chang
*Assistant Examiner* — Eric Eide
(74) *Attorney, Agent, or Firm* — Beyer Law Group LLP

(57) ABSTRACT

A lighted hand tool includes a cylindrical-shaped rivet member, and a first and second tool member each having a handle, a jaw, and a pivot portion therebetween. A cylindrical bore section is defined by each pivot portion, and each bore is in co-axial alignment for aligned receipt of the rivet member therein. The rivet member prevents lateral separation of the first and second hand tool therebetween, while enabling pivotal movement of the jaw portions. An illumination device is formed for sliding receipt in the receiving channel of the rivet member, and aligns an output portion with the communication port to illuminate the work area. A first end cap and second cap are threadably disposed in the opposite openings into the rivet member. The first and second end cap cooperate to securely abut and seat the illumination device therebetween.

11 Claims, 15 Drawing Sheets

(51) Int. Cl.
*B25B 7/08* (2006.01)
*B25B 7/10* (2006.01)

(56) References Cited

U.S. PATENT DOCUMENTS

| | | | | |
|---|---|---|---|---|
| 5,678,919 | A | 10/1997 | Huang | |
| 5,921,654 | A | 7/1999 | Coyle | |
| 6,273,582 | B1 | 8/2001 | Taggart et al. | |
| 6,296,365 | B1 | 10/2001 | McCalla et al. | |
| 6,477,925 | B2 | 11/2002 | Lin | |
| 7,399,101 | B2 | 7/2008 | Clausen et al. | |
| 2007/0019400 | A1 * | 1/2007 | Clausen et al. | 362/109 |
| 2012/0014096 | A1 | 1/2012 | Wang | |

FOREIGN PATENT DOCUMENTS

| | | |
|---|---|---|
| JP | 2003-305661 | 10/2003 |
| KR | 10-1998-0022919 | 7/1998 |

OTHER PUBLICATIONS

Written Opinion dated Nov. 5, 2014 from International Application No. PCT/US2014/052872.

International Search Report dated Jun. 19, 2015 from International Application No. PCT/US2015/022984.

Written Opinion dated Jun. 19, 2015 from International Application No. PCT/US2015/022984.

* cited by examiner

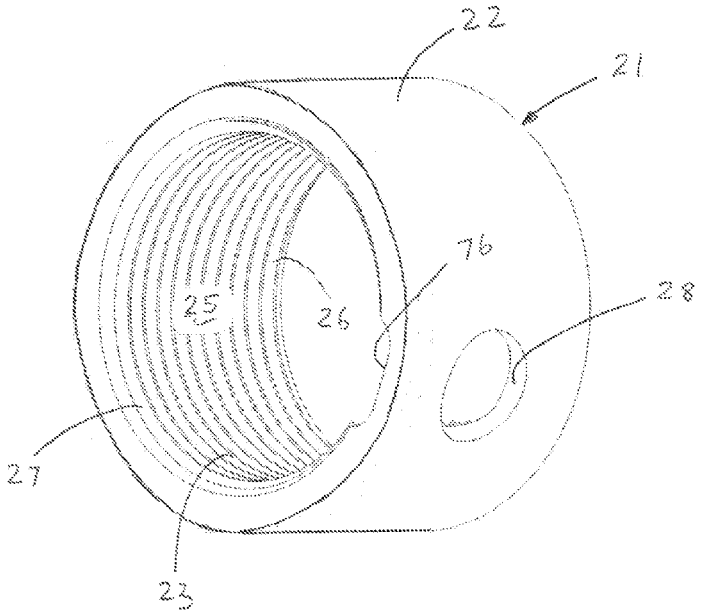
FIG._12
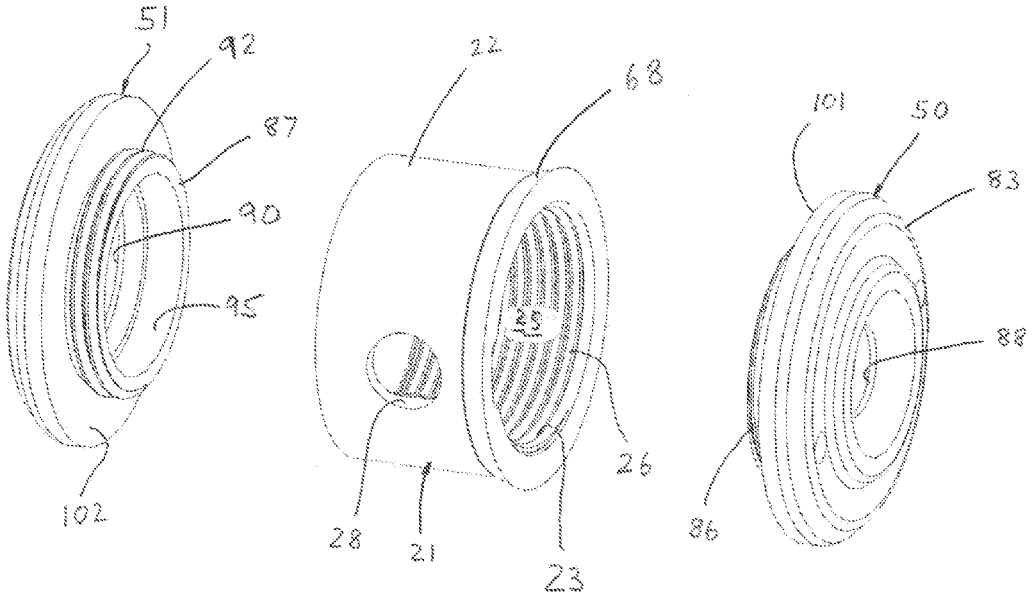

ILLUMINATED HAND TOOL ASSEMBLY

RELATED APPLICATION DATA

The present application claims priority under 35 U.S.C. §119 to U.S. Provisional Application No. 61/871,083, naming Brauner et. al as inventors, filed Aug. 28, 2013, and entitled ILLUMINATED PLIERS ASSEMBLY, which is incorporated herein by reference in their entirety and for all purposes.

FIELD OF THE INVENTION

The present invention relates to hand operated tools, and more particularly, relates to illuminated hand tool assemblies

BACKGROUND OF THE INVENTION

Poorly lit work environments will always pose additional risks to any personnel operating hand tools. This problem is particularly troublesome for industrial application where equipment that is located next to other components that can easily be damaged or that present a hazard to the technician, such as exposed high-voltage sources or heavy equipment.

While external lighting is an obvious solution, it may not always be practical due to space and power source limitations where such tools are to be applied. For example, the external light may require it to be connected to an outlet by an extension cord and that the technician hangs in a position to illuminate the component. Such outlets, of course, are not always located near the equipment that is to be serviced. Furthermore, the light may relatively large so that technicians may not normally carry them when inspecting and adjusting equipment.

Several hand tools have been developed that contain their own light source, instead of depending upon the need for external lighting. The advantage of this approach is that the beam of light contained in the tool generally can be directed at the work area where the technician is performing the work without any additional manipulation and maneuvering of the light source.

One significant problem with most of these lighted hand tool approaches is that either the light generated by the tool is of lower intensity and insufficient, or the addition of the light impair the use of the tool. Accordingly, there is a need for improved lighted hand tool, such as a lighted pliers hand tool, that has a high intensity light source with a low power consumption that will provide illumination directly to the desired work area or object to be grasped by the pliers hand tool.

SUMMARY OF INVENTION

The present invention provides a lighted hand tool apparatus including a generally cylindrical-shaped rivet member having an exterior wall and a threaded interior wall defining a receiving channel longitudinally extending from a first opening at one end of the rivet member to a second opening at an opposite end thereof. The rivet member defines a side communication port radially extending into the receiving channel from the exterior wall to the interior wall. The hand tool further includes a first tool member and a second tool member each having a respective handle portion, a jaw portion, and an intermediate pivot portion therebetween. Each respective pivot portion defines a respective generally cylindrical bore section each extending substantially laterally across the corresponding pivot portions from an inner facing wall to an outer facing wall. The bore sections are in co-axial alignment for aligned receipt of the rivet member therein such that in a secured condition, each are in co-axial alignment with one another for aligned receipt of the rivet member therein. In a secured condition, the rivet member prevents lateral separation of the first and second hand tool therebetween. The rivet member, however, also simultaneously interconnects the tool members together for relative pivotally movement, about a rotational axis, of the respective jaw portions. The pivotal movement of the jaw portions collectively define a work area between an opened condition and a closed condition. The rivet side communication port is in communicative alignment with a respective central passageway defined by at least one respective pivot portion and extends from the respective bore section to an end port terminating at the work area. This passageway permits light communication from the rivet member receiving channel to the work area during operative use of the hand tool.

In accordance with the present invention, the tool apparatus further includes an illumination device having an illumination output portion outputting a direct light beam therefrom. The illumination device further includes a housing formed and dimensioned for removable, axial sliding receipt in the receiving channel of the rivet member in a manner aligning the output portion with the side communication port to directly illuminate the work area during operative use. A first end cap is threadably disposed in the first opening of the rivet member. Similarly, a second end cap is threadably disposed in the second opening of the rivet member. The first and second end cap cooperate to securely abut and seat the illumination device therebetween.

In one specific embodiment, the output portion of the illumination device includes an alignment key portion extending radially outward from the exterior surface of the housing. The direction of the output portion is generally perpendicular to a longitudinal axis of the illumination device.

In another configuration, the rivet member further defines an alignment slot defined by the threaded interior wall. The alignment slot is formed and dimensioned for sliding receipt of the alignment key of the housing as the illumination device is received in the central passage.

In yet another specific embodiment, the illumination device includes a button assembly on one end of the housing. The first end cap includes a cover disk portion defining a button port formed for receipt of at least a portion of the button assembly. This enables operable access thereof when threadably mounted to the rivet member.

Yet another embodiment includes an illumination device with a battery cover on an opposite end of the housing. The second end cap includes a cover disk portion defining a battery cover port formed for operable access to the battery cover when threadably mounted to the rivet member.

In another embodiment, each the first end cap and the second end cap include respective annular contact walls downwardly depending from an underside of the respective cover disk portion thereof. Each respective contact wall includes an exterior facing wall configured for threaded engagement with the threaded interior wall of the rivet member. Moreover, each contact wall further includes an interior facing wall defining a respective receiving recess which is formed and dimensioned for respective seated receipt of the one end and the opposite end the housing when both the first end cap and the second end cap are threadably mounted to the rivet member.

In yet another specific embodiment, each respective bore section of the first and second tool member is defined by a substantially cylindrical interior wall. Further, each bore section is co-axially aligned relative one another. The cylindrical interior wall of the first tool member is sized and dimensioned for press-fit mounting around the exterior wall of the rivet member, fixedly mounting the first tool member to the rivet member. The cylindrical interior wall of the second tool member is sized and dimensioned for snug mounting around the exterior wall of the rivet member, allowing pivotal movement of the second tool member about the rotational axis.

In one specific embodiment, each respective bore section includes opposed, outer retaining chamfers tapering radially outwardly from the respective interior wall thereof toward the respective outer facing wall. The opposed ends of the rivet member include annular retaining lips flaring radially outward, and generally abutting the respective retaining chamfers, self-retaining the rivet member between the respective bore sections.

Yet another configuration provides that the annular retaining lips are swage formed.

In another configuration, the respective central passageway is generally oriented along a longitudinal axis that is substantially perpendicular the rotational axis.

In still another aspect of the present invention, a lighted hand tool apparatus is provided having a first tool member and a second tool member both similarly mounted in a cross-jaw configuration. The first tool member includes a head portion having a first jaw section and an interface section. The first tool member further includes a first handle portion and an elongate interlock portion that integrally connects the handle portion to the head portion. Further, the elongate interlock portion has a longitudinal axis and intersects a work surface of the first jaw section, at the head portion interface section, at an angle therebetween. The interface section further defines a receiving channel extending laterally therethrough from one side of the interface section to an opposite thereof. A communication channel is also included extending radially from the receiving channel to an end port that terminates at the work surface for light communication therebetween. The second tool member similarly includes a second jaw portion, a second handle portion and a coupling portion integral between the second jaw portion and the second handle portion. The coupling portion cooperates with the elongate interlock portion to movably couple the second tool member to the first tool member in a crossed orientation such that the first and second jaw portions are offset to one side of the longitudinal axis of the elongated interlock portion. The coupling portion is further manually movable along the longitudinal axis of the elongated interlock portion to adjust the size of the work area defined between the first and second jaw portions.

An illumination device is included having an illumination output portion that outputs a direct light beam therefrom. The illumination device includes a housing that is formed and dimensioned for removable, axial sliding receipt in the receiving channel of the interface section such that the output portion is aligned with the communication channel. The illuminated hand tool apparatus further includes a first end cap disposed in a first opening into receiving channel, and a second end cap disposed in an opposite second opening into the receiving channel. The first end cap and the second end cap cooperate to securely abut and seat the illumination device therebetween.

In one specific embodiment, the illumination device of the hand tool apparatus includes an alignment key portion upon which the output portion resides. The alignment key portion extends radially outward from the exterior surface of the housing, and is oriented generally perpendicular to a longitudinal axis of the illumination device. The alignment key is further formed and dimensioned for sliding receipt in a portion of the communication channel.

In another specific embodiment, the communication channel tapers outwardly from the receiving channel to the end port.

In yet another configuration, the illumination device includes a button assembly on one end of the housing, and a battery cover on an opposite end thereof. Moreover, the first end cap includes a cover disk portion defining a button port formed for receipt of at least a portion of the button assembly to enable operable access thereof when mounted in the first opening of the receiving channel. Further, the second end cap also includes a cover disk portion defining a battery cover port formed for operable access to the battery cover when mounted the second opening of the receiving channel.

Still another embodiment provides a threaded interior wall of the interface section that defines the receiving channel is threaded. Each of the first and second end cap is further configured to be threadably mounted to the interior wall.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

FIG. 12 is an enlarged, side perspective view of the rivet member of the lighted hand tool apparatus of FIG. 1.

FIG. 13 is an enlarged, exploded, side perspective view of the rivet member and a first end cap and a second end cap of the lighted hand tool apparatus of FIG. 1.

DETAILED DESCRIPTION OF THE INVENTION

Figure 1:
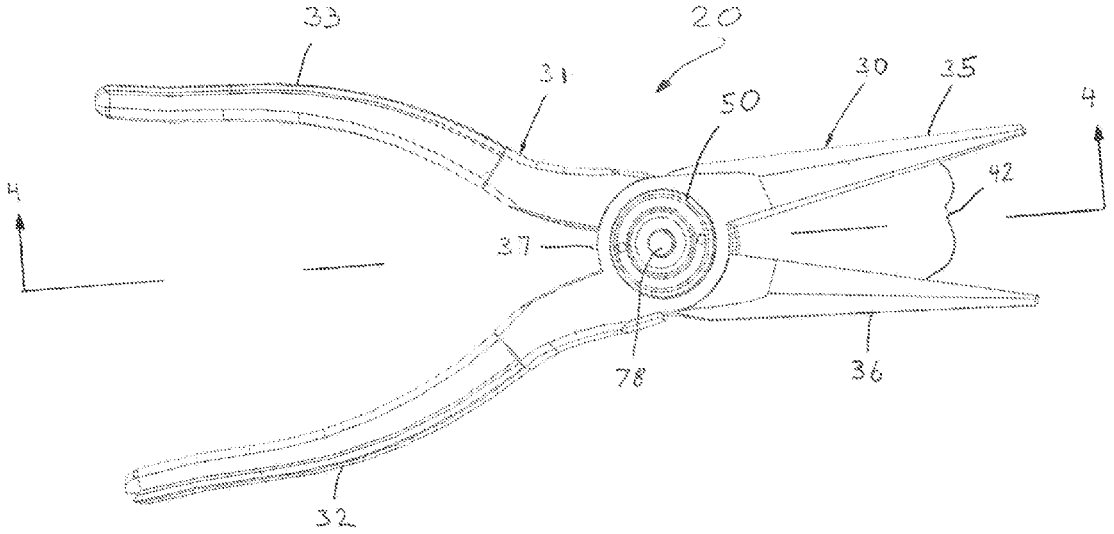
FIG. 1 is a side perspective view of a lighted hand tool apparatus constructed in accordance with the present invention, illustrated in an opened condition.
Figure 2:
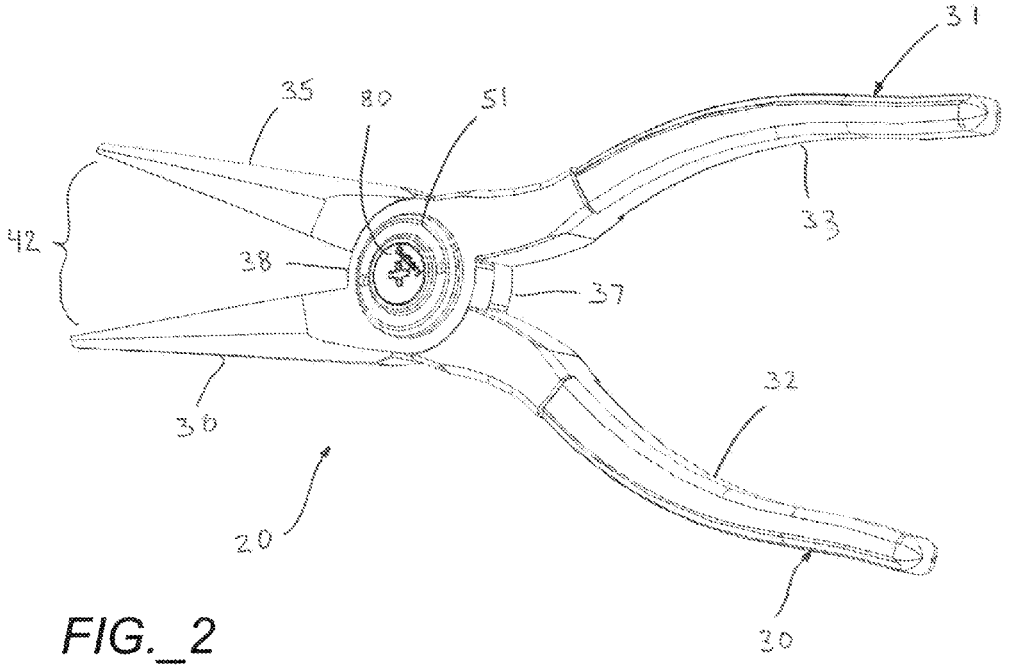
FIG. 2 is an opposite side perspective view of the lighted hand tool apparatus of FIG. 1.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Referring now to FIGS. 1-7, 12 and 13, a lighted hand operated tool apparatus, generally designated 20, is shown including a generally cylindrical-shaped rivet member 21 having an exterior wall 22 and a threaded interior wall 23 defining a receiving channel 25. This channel extends longitudinally from a first opening 26 at one end of the rivet member 21 to a second opening 27 at an opposite end thereof. The rivet member 21 additionally defines a side communication port 28 radially extending into the receiving channel 25 from the exterior wall 22 to the threaded interior wall 23 thereof. The hand tool apparatus further includes a first tool member, generally designated 30, and a second tool member, generally designated 31. Each hand tool member 30, 31 includes a respective handle portion 32, 33, a jaw portion 35, 36, and an intermediate pivot portion 37, 38, therebetween. Each respective pivot portion 37, 38 further defines a respective generally cylindrical bore section 40, 41 extending substantially laterally across the corresponding pivot portion 37, 38. The bore sections 40, 41, are further configured for co-axially aligned receipt of the rivet member 21 therein. In a secured condition, the rivet member 21 prevents lateral separation of the first and second tool members 30, 31 from one another, while simultaneously interconnects them together for relative pivotally movement of the respective jaw portions 35, 36. This movement collectively defines a work area 42 as the jaw portions move between an opened condition (FIG. 3, although nearly every figure) and a closed condition. When the rivet member 21 is in the secured condition, the rivet member communication port 28 is in communicative alignment with a respective central passageway 43, 45 defined by at least one of the respective pivot portions 37, 38. These passageways 43, 45 extend from the respective bore section 40, 41 to an end port 46 which terminates at the work area to permit communication of the rivet member receiving channel 25 with the work area 42 during operative use.

The hand tool apparatus further includes an illumination device 47 (FIGS. 4, 5, 14 and 15) having an illumination output portion 48 outputting a direct light beam therefrom. The illumination device includes a housing 49 formed and dimensioned for removable, axial sliding receipt in the receiving channel 25 of the rivet member 21 in a manner aligning the output portion 48 with the side communication port 28 to directly illuminate the work area 42 during operative use. A first end cap 50 (FIGS. 1, 3, 5 and 19-21) is included that is threadably disposed in the first opening 26 of the rivet member 21 while an opposed second end cap 51 (FIGS. 2, 5 and 22-24) is threadably disposed in the second opening 27 of the rivet member 21. The first end cap 50 and the second end cap 51 cooperate to securely abut and seat the illumination device 47 therebetween.

Accordingly, a handheld hand tool assembly is provided having a light assembly housed in the pivot portion between the two hand operational tool members, similar to our previous design, U.S. Pat. No. 7,399,101, herein incorporated by reference in its entirety. Unlike previous designs, however, complete assembly of the end caps and illumination device with the hand tool members is not necessary to prevent lateral separation therebetween. In other words, in these prior designs, disassembly of the hub device, which housed the illumination devices, would also cause disassembly of the hand tool members.

In accordance with the present invention, the hollow rivet member 21 not only houses and seats the illumination device 47, but also functions to retain the first and second tool members 30, 31 laterally together. Moreover, this rivet member also provides pivotal support to the hand tool members, enabling pivotal operation about the hand tool assembly's rotational axis 55

Figure 6:
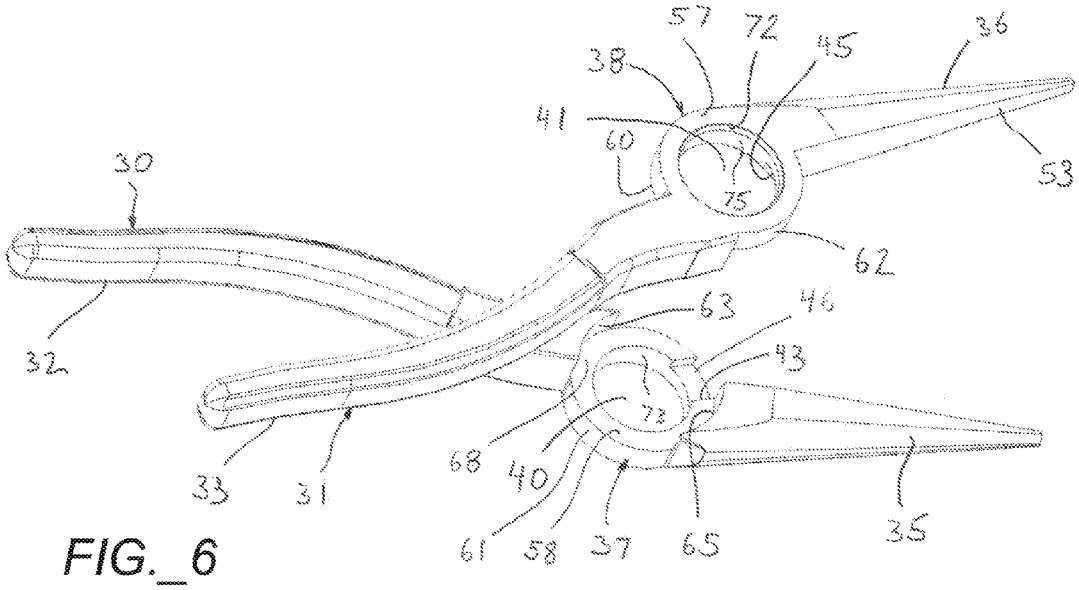
FIG. 6 is an exploded, rear perspective view of a first tool member and second tool member of the lighted hand tool apparatus of FIG. 1, prior to interengagement at their respective pivot portions.
Figure 7:
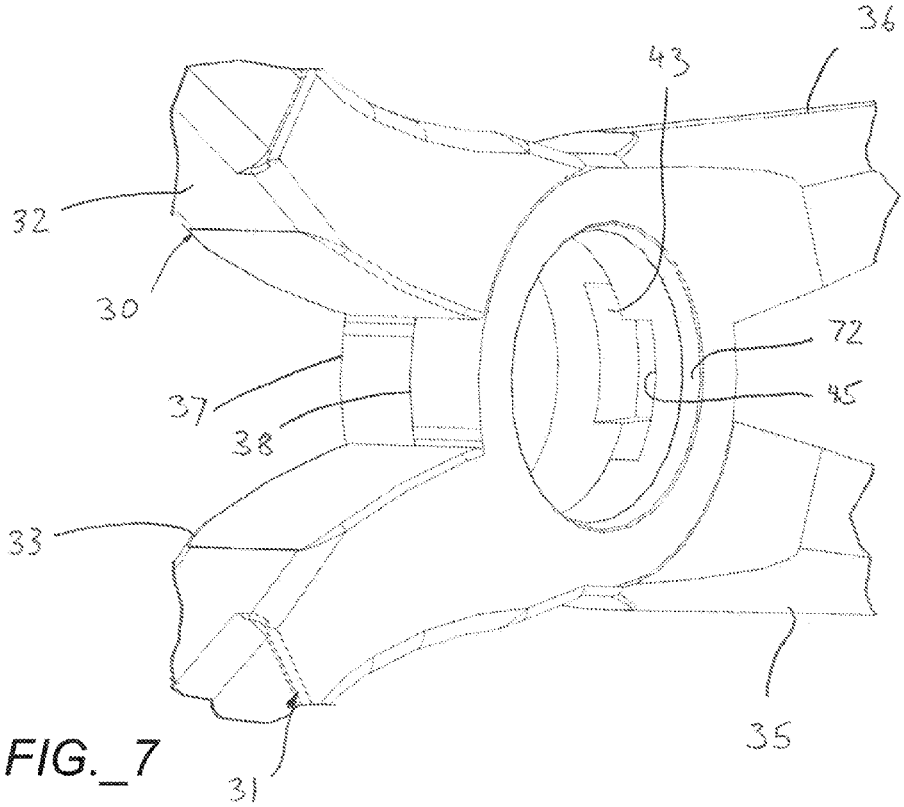
FIG. 7 is an enlarged, fragmentary, rear perspective view of the first and second tool members of FIG. 6, after interengagement their respective pivot portions.

FIGS. 6 and 7 best show that the first tool member 30 and the second tool member 31 are generally identical to another but are flipped around 180 Deg, relative to one another during assembly, and are interengaged at their respective pivot portions 37, 38 to co-axially align their respective bore sections 40, 41, in a cross-jaw formation. Similar to most "cross-jaw" hand tool designs, by squeezing the respective handle portions 32, 33 together, the gripping force of the opposed jaw portions 35, 36 can be controlled from the opened condition (FIGS. 1-3 and 7) toward the closed condition.

Each hand tool member 30, 31 is preferably comprised of a metallic material, for strength purposes, and is more preferably comprised of stainless steel. It will be appreciated, however, that the hand tools may be composed of other lightweight, synthetic or exotic materials.

As previously mentioned, each respective jaw portion 35, 36 includes an opposed work surface 52, 53 that collectively define the work area 42 when the hand tool members 30, 31 are operationally interconnected about the rivet member 21. While the shape and area of the work surfaces 52, 53 are shown as being relatively trapezoidal and substantially planar, these dimensions may be varied, and the work surfaces may be conventionally teethed, kneeled or ridged to promote frictional gripping.

Further, the footprint of each jaw portion 35, 36 is shown in a "needle-nose" pliers shape, where the jaw portions taper inwardly from the proximal end to the distal end thereof. This tapered shape is particularly useful for certain applications such as for fishing. Other conventional pliers jaw shapes can be implemented as well, however, depending upon the desired application, without departing from the true spirit and nature of the present invention. In fact, it will be appreciated that this embodiment of the present invention applies to any "cross-jaw" hand tool designs, such as slip joint pliers, lineman's pliers, round-nose pliers, flat-nose pliers, crimping pliers, circlip pliers, diagonal pliers, nippers, cutters and pincers, etc.

Figure 3:
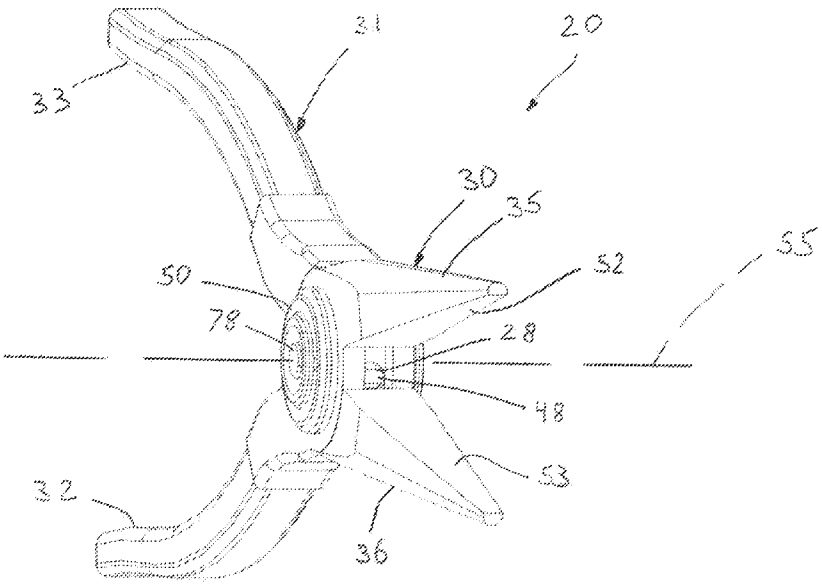
FIG. 3 is a front perspective view of the lighted hand tool apparatus of FIG. 1
Figure 4:
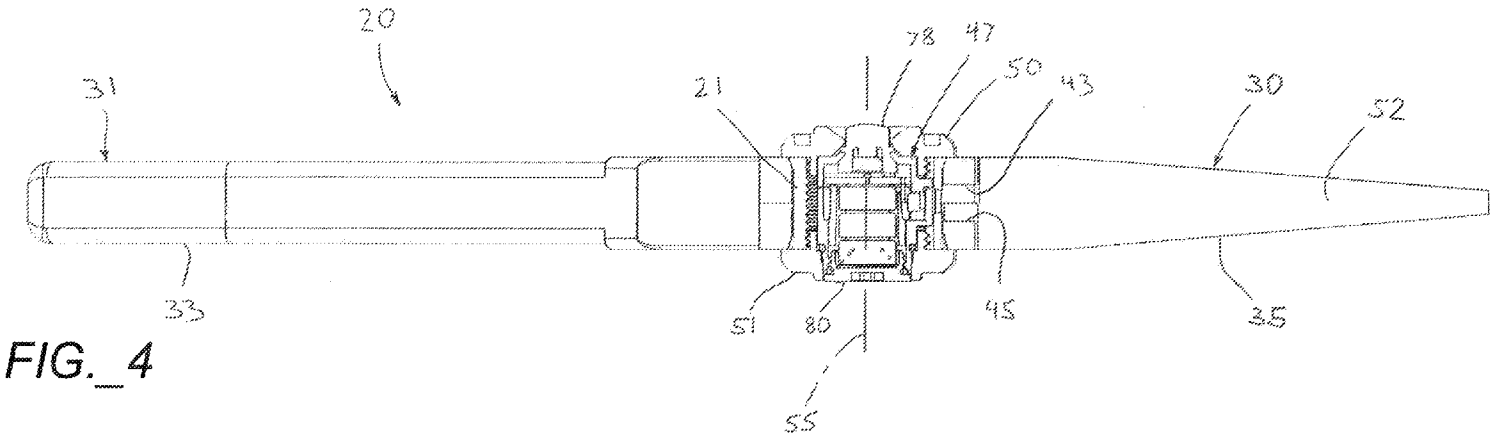
FIG. 4 is a bottom plan view, in cross-section, of the lighted hand tool apparatus taken along the plane of the line 4-4 in FIG. 1.
Figure 11:
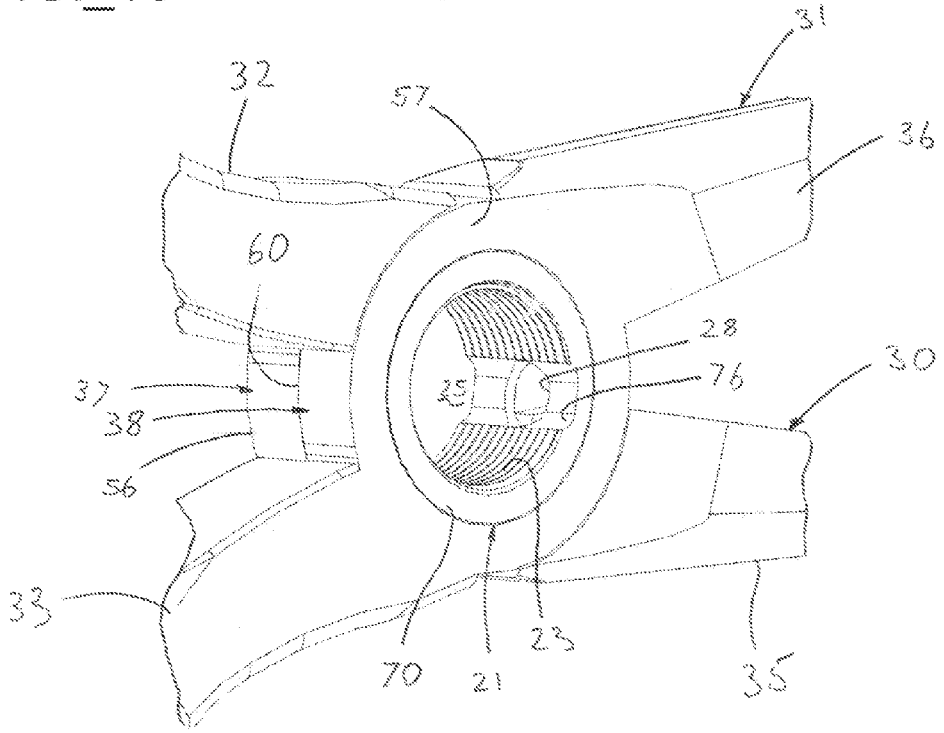
FIG. 11 is a fragmentary, rear perspective view of the first and second tool member of FIG. 7 with the rivet member installed.

With respect to the handle portions 32, 33, each is curved along a path generally opposite to one another when the hand tool members 30, 31 are operationally interconnected at the pivot portions 37, 38 via the rivet member 21 (i.e., FIGS. 3 and 11). Such curvatures, however, can be altered for a desired application, or the handle portions may be relatively linear. Moreover, the handle portions 32, 33 may be knurled or textured to enhance gripping, or may include plastic or rubber sleeves and grips, also to promote gripping and comfort.

Figure 8:
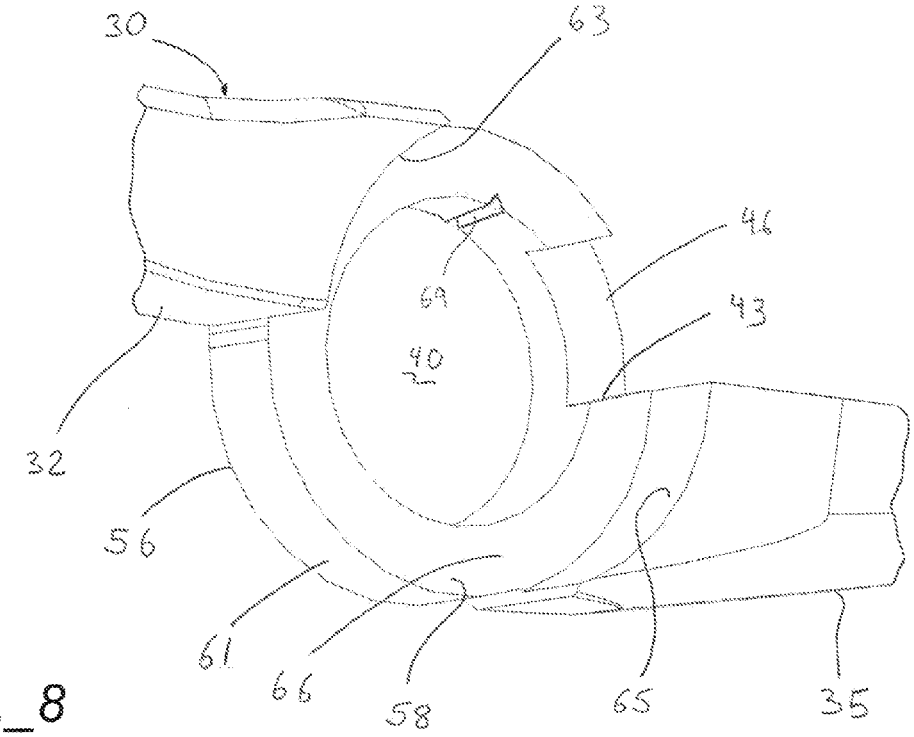
FIG. 8 is a fragmentary, rear perspective view of only the first tool member of FIG. 6.

Coupling the respective handle portion 32, 33 to the respective jaw portion 35, 36 in each the first and second tool member 30, 31, is the respective pivot portion 37, 38. Briefly, each respective pivot portion 37, 38 is generally disk-shaped and defines the respective bore section 40, 41 extending laterally therethrough from a respective outer facing wall 56, 57 to a respective inner facing wall 58, 60 thereof. Each bore section is also generally cylindrical shaped, and generally concentric to each corresponding pivot portion, forming respective pivot rings 61, 62. This is best shown in FIG. 8, which illustrates only first tool member 30 itself for descriptive purposes. Here it can be seen that one circumferential portion of the pivot ring 61 is integrally formed with a distal portion of the respective first handle portion 32 while opposite circumferential portion is integrally formed with a proximal portion of the first hand tool jaw portion 35.

The width of the respective pivot ring 61 is narrower than that of the adjoining distal portion of the handle portion 32, and of the adjoining proximal portion of the respective jaw portion 35. Accordingly, portions of the distal end wall 63 of the respective first handle portion 32, and of the proximal end wall 65 of the first tool jaw portion 35 cooperate to define a partial receiving socket 66, formed and dimensioned for rotational receipt of the opposed pivot ring 62 of the second tool member 31. Similarly, the corresponding partial receiving socket 66 of the pivot portion 38 of the second tool member 31 is formed and dimensioned for rotational receipt of the opposed pivot ring 61 of the first tool member 30 (FIGS. 6-8).

In general, the corresponding pivot rings 61, 62 are off-set to the outside of the pivot portion, opposite that of the respective receiving sockets 66, 67. Moreover, the width of the pivot ring 61 is about one-half the width of the distal end wall 63 of the respective first handle portion 32, and of the proximal end wall 65 of the first tool jaw portion 35. Accordingly, when the first and second tool members 30, 31 are flipped over 180 Deg, relative to one another, and are assembled such that the respective pivot rings 61, 62 are received in the opposing receiving sockets 66, 67, co-axially aligning the respective bore sections (FIGS. 6 and 7), it will be appreciated that the collective width of the pivot rings 61, 62 is similar to, and integral with, the corresponding ends of the opposed jaw portions 35, 36 and handle portions 32, 33.

FIGS. 6 and 11 further illustrate that at least one of the pivot portions 37, 38 includes a respective central passageway 43, 45 extending from the respective bore section 40, 41 to an end port 46 terminating at the work area 42. These passageways 43, 45 enable light communication (i.e., from the illumination device 47) from the receiving channel 25 of the rivet member 21 to the work area during operable use of the first and second tool members 30, 31. Preferably each respective pivot portion 37, 38 defines its own generally rectangular prism-shaped central passageway 43, 45. These two opposed passageways 43, 45 cooperate to enable light transmission from the mounted illumination device 47 to the work area.

In accordance with the present invention, in the secured condition, the rivet member 21 laterally retains the pivoting first and second tool members together regardless of whether or not the illumination device, and/or end caps are secured to the hand tool apparatus 20 (FIGS. 5 and 9-11). That is, once the rivet member is oriented in the secured condition, as will be described in greater detail, the hand tool members 30, 31 will no longer be capable of axial separation from one another along the rotational axis 55.

However, the rivet member 21 must enable relative rotation of at least one of the hand tool members 30, 31 about the common rotational axis 55, lest the hand tool members could not rotate relative to one another. On the other hand, allowing the tubular rivet member 21 to freely rotate about the rotational axis 55 would be disadvantageous since the output portion 48 of illumination device 47 would then also rotate freely about the rotational axis. Consequently, the output portion 48 could then be easily misaligned with the pivot potion central passageways 43, 45.

Accordingly, the rivet member 21 is fixedly mounted in the bore section 40, 41 of either the first tool member 30 or the second tool member 31, preventing relative rotation with at least one hand tool member thereof. Such fixation can be performed using any conventional technique including adhesives, lock screws, keys, etc., Other techniques include press-fit mounting, ribbing of one or both opposed surfaces, and/or heat treatment and pressure.

Figure 9:
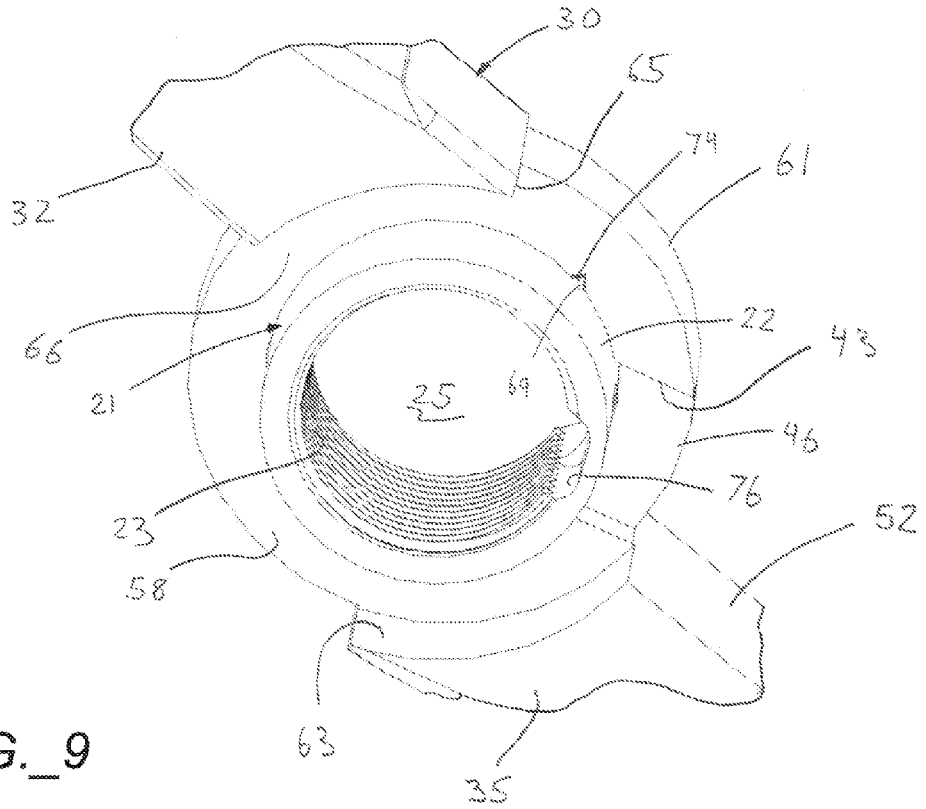
FIG. 9 is a fragmentary, rear perspective view of the first tool member of FIG. 6 with a rivet member installed.
Figure 10:
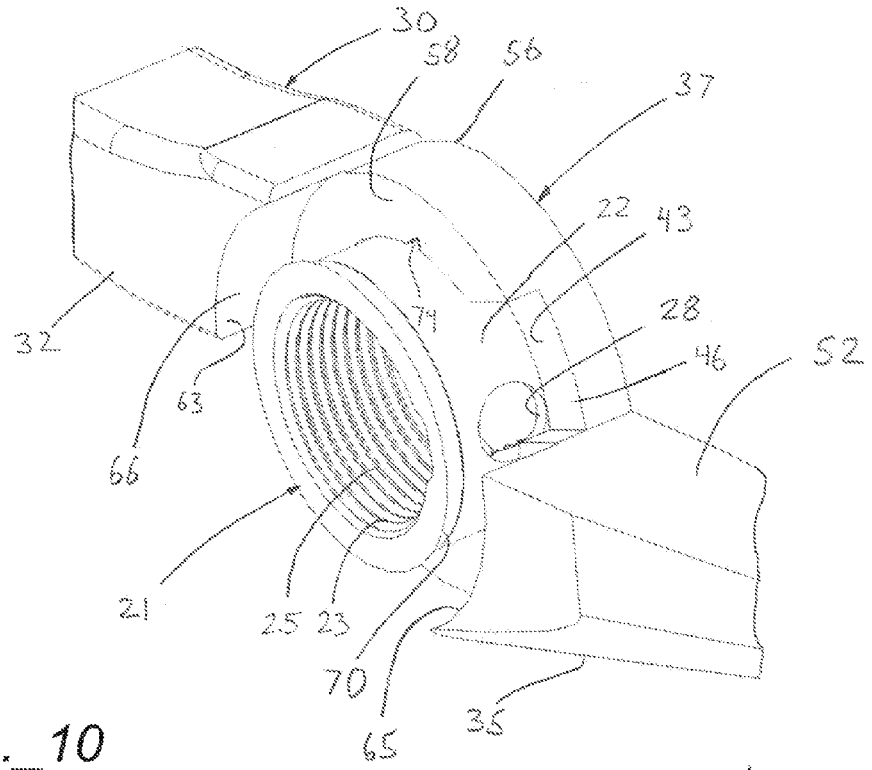
FIG. 10 is a fragmentary, front perspective view of the first tool member of FIG. 9, but illustrating one end of the rivet member with a swaged, annular retaining lip.

In one particular example, as shown in FIGS. 8-10, the interior wall 73 that defines bore section 40 may include a channel or notch 69 that extends in laterally thereacross. When the rivet member 21 is slideably and snugly received in the bore section 40, and the rivet member is press-forged or swaged, as will be described in greater detail below, retaining the hand tool members 30, 31 together, the exterior wall 22 can be sufficiently flow into the notch 69. A rib 74 is formed, that will prevent the rotation of rivet 21 within the bore section 40.

In another example, press-fit or interference-fit mounting of the rivet member 21 into one of the bore sections 40, 41 of the either the first tool member 30 or the second tool member 31 could be accomplished by forcing the rivet member 21 into a slightly undersized bore section. That is, by simply adjusting the diameter of the bore section 40, 41 that is forged and/or milled into the respective corresponding pivot portion 37, 38, the hand tool member 30 can be configured to either be affixed to the hand tool member or rotate relative to the same. A slightly smaller diameter of the bore section than that of the exterior wall 22 of the rivet member 21, for instance, for a press-fit mount, or conversely, a slightly larger bore diameter than that of the rivet member 21 for a rotating mount.

FIGS. 9 and 12 best illustrates that the rivet member 21 is initially a cylindrical, tubular structure composed of a metallic material. Similar to the hand tool member components, the rivet member is more preferably composed of stainless steel.

Both the exterior wall 22 and the interior wall 23 are initially relatively smooth. As mentioned, the bore diameter of the bore section 40 of the first tool member 30 is slightly smaller than that of the rivet member outer diameter, creating a press-fit or interference fit engagement therebetween. For example, the outer diameter of the rivet member 21 may be in the range of about 19.0 mm to about 20.0 mm, while that of the bore section 40 of the first tool member may be in the range of about 15.5 mm to about 16.5 mm. In contrast, the diameter of the bore section 41 of the second tool member 31 may be in the range of about 19.5 mm to about 20.5 mm, enabling relative rotation therebetween albeit still providing a snug fit.

Prior to affixation of the rivet member 21 to the first tool member 30, for example, the side communication port 28 of the rivet member is rotationally aligned with the central passageway 43. With respect to the central passageway 43 of the first tool member 30, the transverse cross-sectional dimension of the central passageway 43 really only needs to be similar to that of the side communication port 28 due to the affixation in the corresponding bore section 40. As above indicated, however, the first and second tool members 30, 31 are identical to one another so as not to require the fabrication of two distinctive parts. Accordingly, at least the height dimension of the transverse cross-sectional area of the central passageways 43, 45 is much taller than that of the side communication port 28. This is necessary to provide a continuous light path therethrough for the illumination device output portion as the opposed tool member (e.g., the second tool member 31) articulates between the closed and opened conditions.

With respect to the smaller cross-sectional dimension of the side communication port 28, thus, proper alignment relative to the central passageway 43 of the first tool member, for instance, is required. Briefly, the preferred alignment orients the side communication port 28 generally in the direction of the corresponding work surface 52 of the first tool jaw portion 35 (FIGS. 9-11). When the illumination device is mounted to the rivet member 21, the light beam for the output portion 48 will always be at least partially directed on the work surface 52. This assures continuous lighting on at least one of the work surfaces of the corresponding jaw member even when the tool apparatus is nearly in the closed position.

To initially assemble the tool members, the rivet member 21 is axially pressed into the corresponding bore section 40 of the first tool member 30 using conventional interference-fit techniques (FIGS. 10 and 11). Briefly, it will be appreciated that FIGS. 10 and 13 show one end of the rivet member 21 with a swaged end, forming a flared retaining lip 68, for illustration purposes which incidentally is not swaged until assembly of the two hand tool members. This will be described in greater detail below.

Returning back to the assembly of the hand tool members, the second tool member 31 is properly oriented such that the hand tool jaw portions 35, 36 are opposed to one another (FIGS. 6 and 7), and that the respective pivot rings 61, 62 are simultaneously received in the opposed receiving sockets 66, 67, axially sliding the rivet member 21 into the second tool bore section 41. In this orientation, as best shown in FIGS. 7 and 11, the respective bore sections 40, 41 of the first and second tool members 30, 31 are oriented adjacent one another and co-axially aligned.

In accordance with the present invention, to axially retain the first and second tool members 30, 31 together, the opposed annular end edges of the rivet member 21 are swaged, flaring these end edges outwardly and radially past the opposed ends of the respective bore sections. This forms the opposed annular retaining lips 68, 70 (FIGS. 5 and 11), in the secured condition, that greater in diameter than that of the respective bore sections, preventing lateral separation of the first and second tool members 30, 31 from one another.

To facilitate the swaging process, the distal edges of the opposed ends of the rivet member are dimensioned to extend slightly just past the opposed outer facing walls 56, 57 of the corresponding pivot portions 37, 38 (not shown). This allows the opposed ends to be swaged radially outward, as well as be swaged flush with the opposed outer facing walls 56, 57. By way of example, the outer edges of the rivet member extend past the opposed outer facing walls by a distance of about 0.5 mm to about 2.0 mm.

Figure 5:
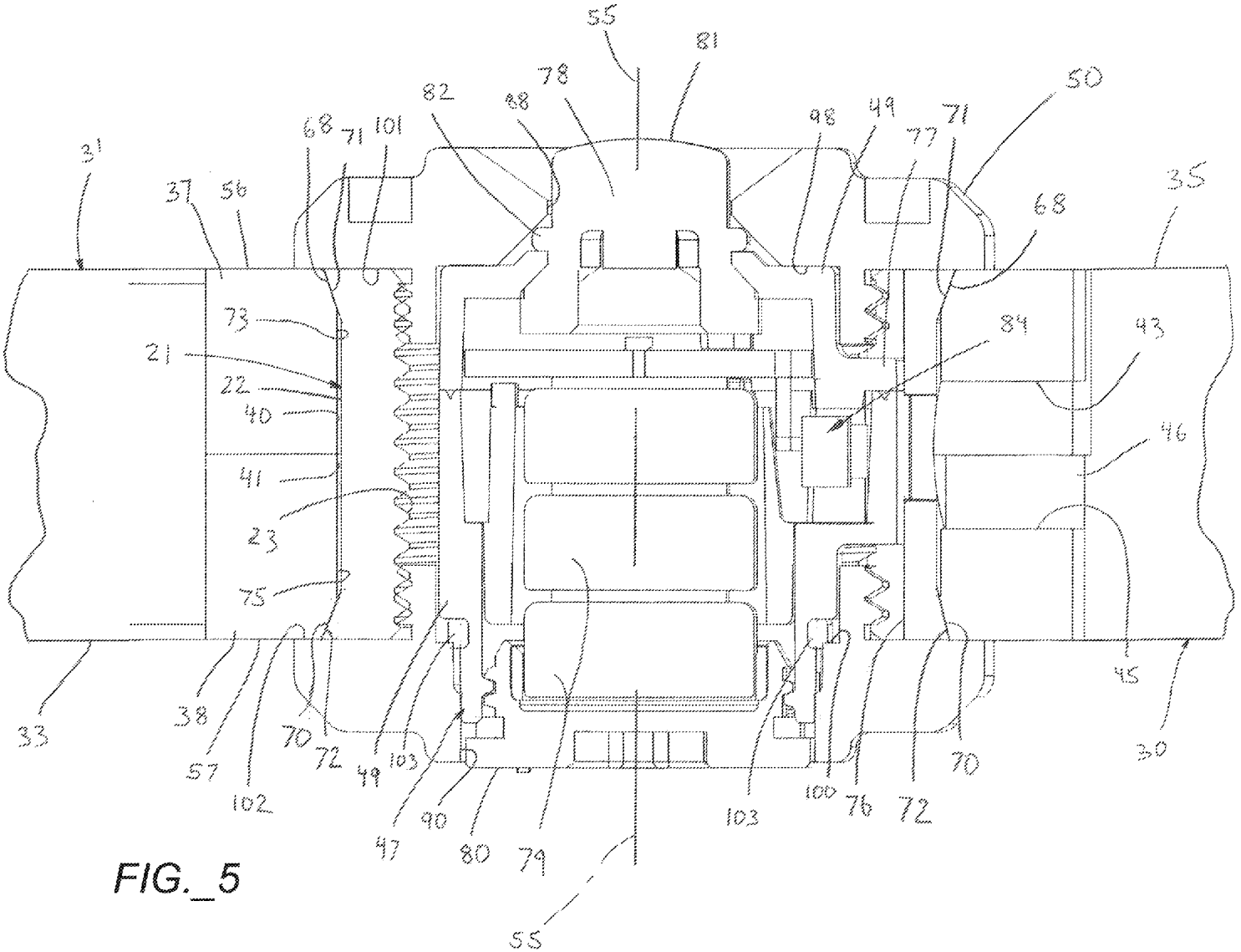
FIG. 5 is an enlarged, fragmentary, bottom plan view of the intermediate pivot portion and illumination assembly of the lighted hand tool apparatus of FIG. 4.

As best shown in FIGS. 5, 10 and 13, to accommodate the swaged retaining lips 68, 70, respective annular retaining chamfers 71, 72 are provided in each pivot portion 37, 38. These chamfers are located proximal to the respective outer portions of the bore sections 40, 41, where the interior walls 73, 75 taper radially outward until they intersect the respective outer facing wall 56, 57 of the pivot rings 61, 62.

Accordingly, when the distal edges of the rivet member 21 are swaged, these edges are pushed radially outward, and deformed into the respective retaining chamfer 71, 72, forming retaining lips 68, 70. These annular chamfers 71, 72, thus, provide an avenue for the retaining lips 68, 70 to expand into during the swaging procedure.

By way of example, each chamfer tapers outwardly at an angle in the range of about 10 Deg to about 20 Deg., and has an axial length of about 1.5 mm. These annular chamfers 71, 72 facilitate retainment of the first and second tool members 30, 31 laterally together, by permitting the outer edges of the rivet member to be swaged outward using convention swaging techniques.

Once the rivet member 21 is secured in the respective bore sections 40, 41 of the pivot portions 37, 38, machined and polished, etc., an alignment slot 76 is cut or milled into the initially unthreaded interior wall 23 of the rivet member (FIGS. 9, 11, 12 and 16). This alignment slot 76 is preferably generally linear, and extends longitudinally along the interior wall 23 in the direction of the rotational axis 55. This alignment slot 76 is formed and dimensioned for sliding axial receipt of an alignment key portion 77 the illumination device housing 49. In turn, this prevents rotation of the illumination device 47 therein. Moreover, the orientation of the alignment slot 76 corresponds with the alignment with the side communication port 28, aligning the illumination device output portion 48 with the rivet communication port and first tool central passageway 43.

Subsequently, the unthreaded interior wall 23 can be tapped, forming the final threaded interior wall 23. This is best exemplified in FIG. 12.

Figure 14:
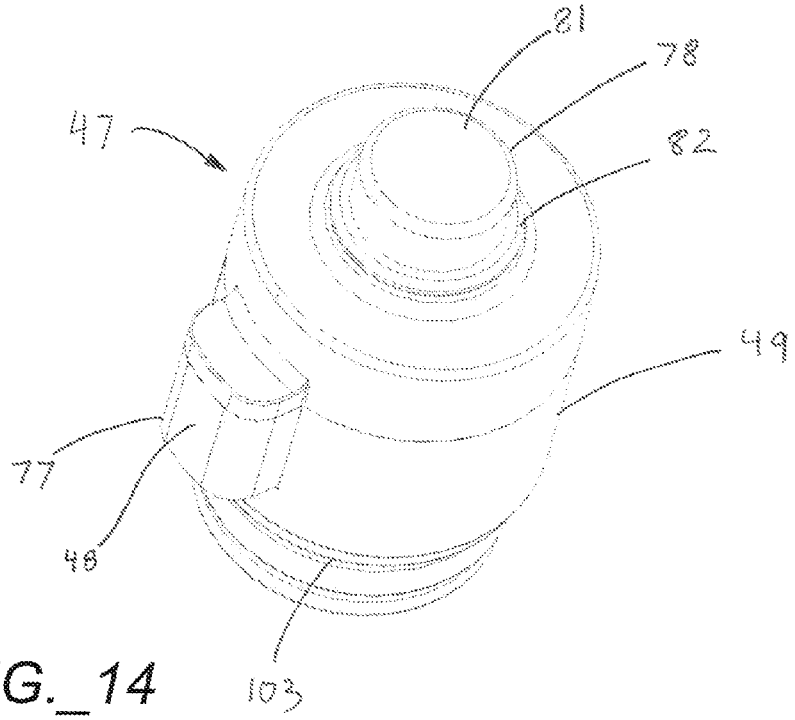
FIG. 14 is an enlarged, top perspective view of an illumination device of the lighted hand tool apparatus of FIG. 1.
Figure 15:
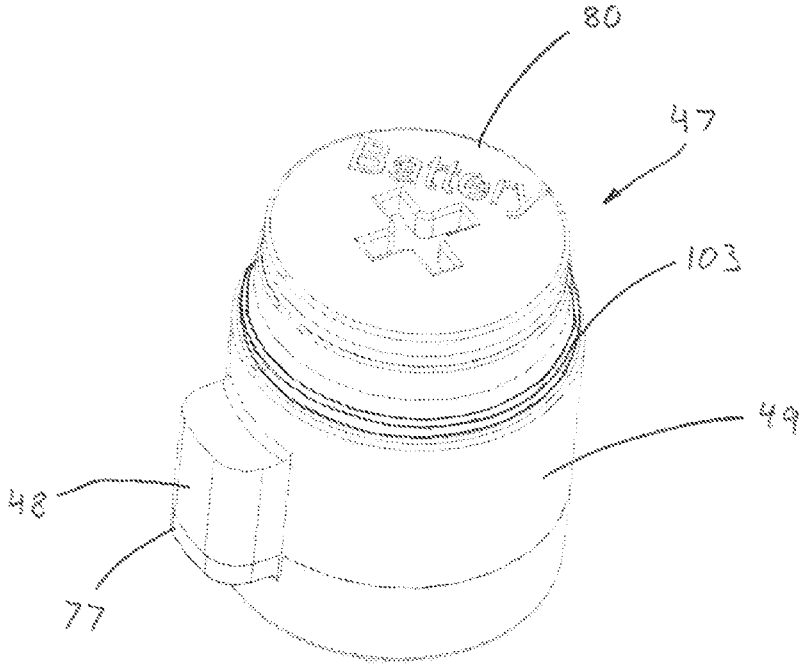
FIG. 15 is a bottom perspective view of the illumination device of FIG. 14.

Turning now to FIGS. 5, 14 and 15, the illumination device 47 is shown having a generally hollow cylindrical housing 49 which supports the manually operated lighting assembly 84 therein (preferably a high intensity LED module). On one end of the housing 49 is an on/off push button 78 to operate the lighting assembly 84, and on an opposite end thereof is a threaded battery access cover 80 to access the batteries 79 seated within the housing. The push button 78 includes a flexible cover, preferably latex or rubber, having a dome-shaped head portion 81 and a seating collar 82 that extends annularly around the head portion 81.

Figure 16:
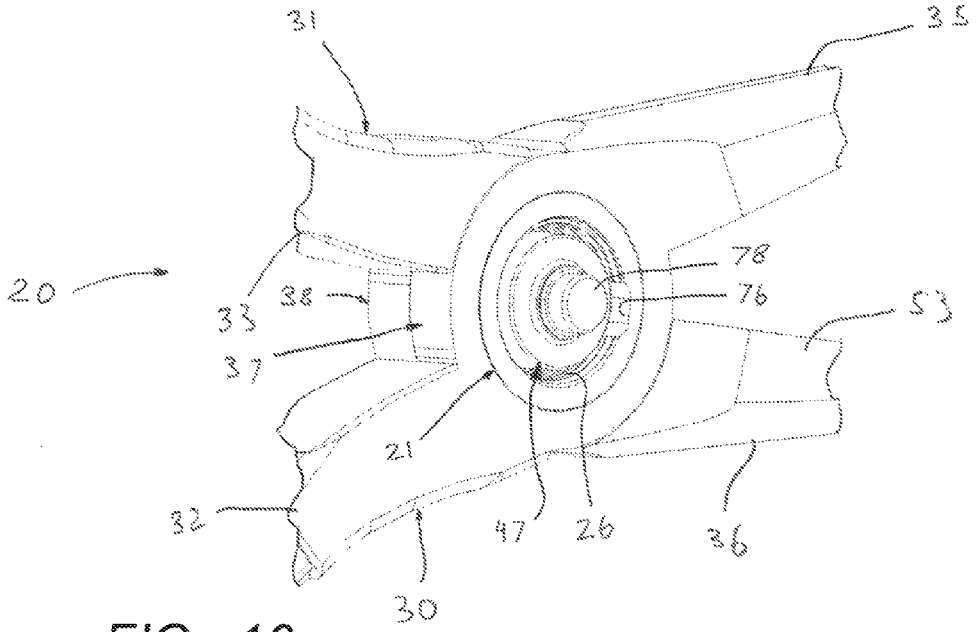
FIG. 16 is an enlarged, fragmentary, rear perspective view of the lighted hand tool apparatus of FIG. 1, without the first end cap installed.
Figure 17:
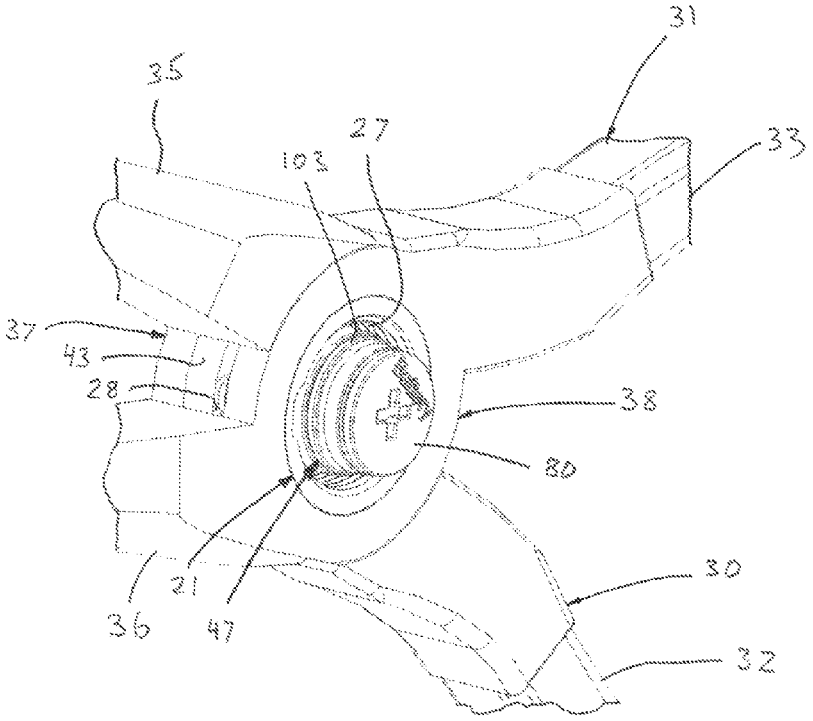
FIG. 17 is an enlarged, fragmentary, opposite rear side perspective view of the lighted hand tool apparatus of FIG. 1, without the second end cap installed.

Protruding radially outward from a side wall of the cylindrical housing 49 is the alignment key portion 77 which houses the output portion 48 of the lighting assembly 84. As also previously indicated, this key portion 77 is formed and dimensioned for sliding axial receipt in the interior alignment slot 76 of the rivet member, aligning the output portion of the light device with the side communication port 28 thereof, and hence, the central passageways 43, 45 of the first and second tool members 30, 31 (FIGS. 5, 16 and 17).

Either the first end cap 50 or the second end cap 51 can be threaded into either bore section 40, 41 of the pivot portion 37, 38 prior to installment of the illumination device 47 in the receiving channel 25 of the rivet member 21. On the other hand, the illumination device 47 can be axially inserted into the rivet receiving channel 25 prior to installment of either end cap 50, 51. It will be appreciated, however, that upon threading engagement of both end caps 50, 51 with the threaded interior wall 23 of the rivet member 21, the end caps cooperate with the housing 49 of the illumination device to sandwich the same therebetween. This cooperating engagement not only axially secures the illumination device, relative to the rivet member, but also secures a water tight seal therebetween.

Figure 18:
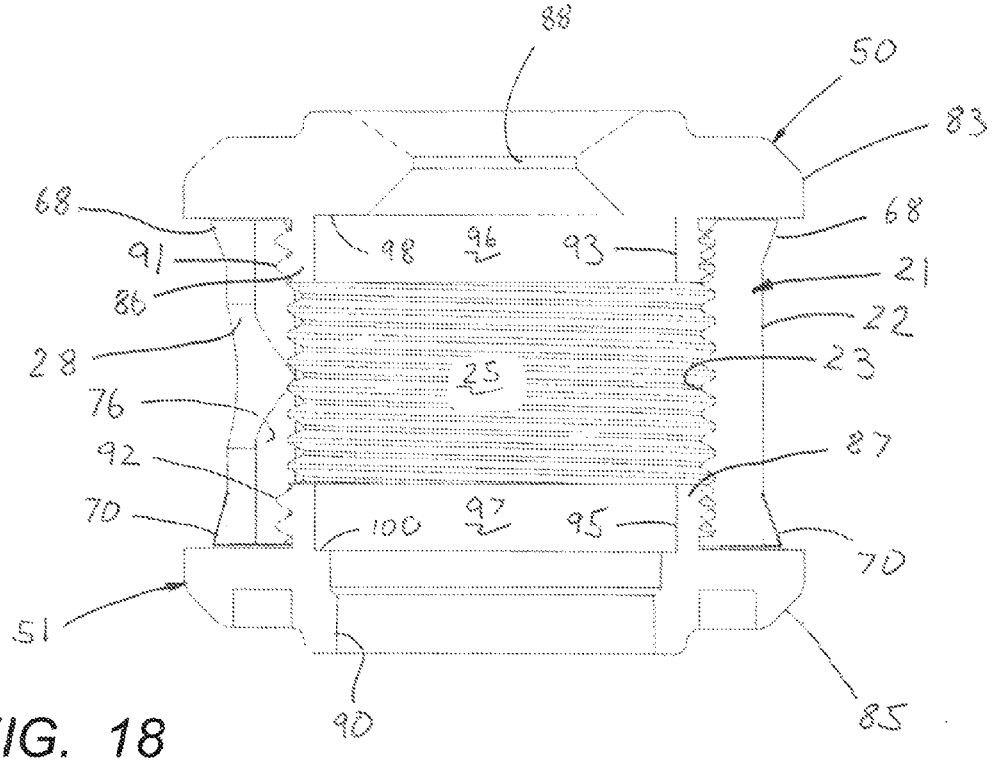
FIG. 18 is an enlarged, top plan view, in cross section, of the assembled rivet member, and first and second end cap of FIG. 13.
Figure 19:
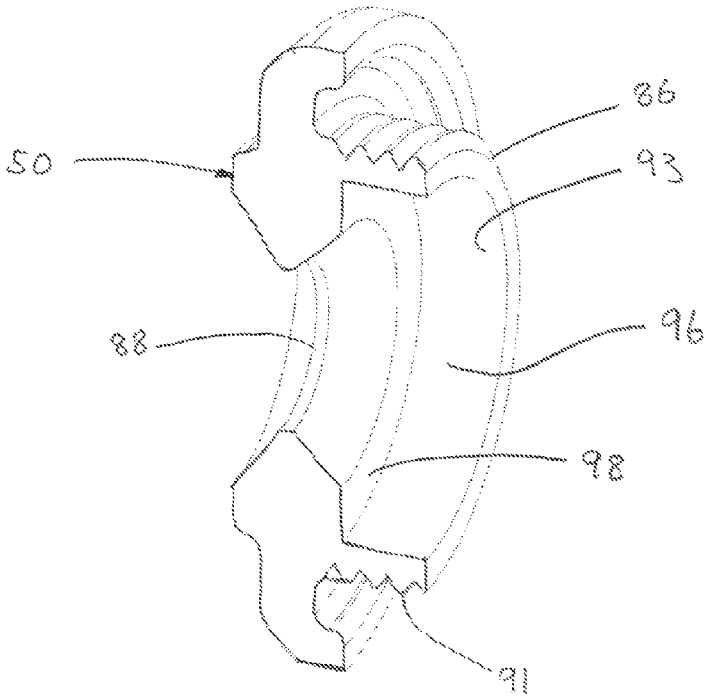
FIG. 19 is an enlarged, bottom perspective view, in cross-section, of the first end cap of the lighted hand tool apparatus of FIG. 1.
Figure 20:
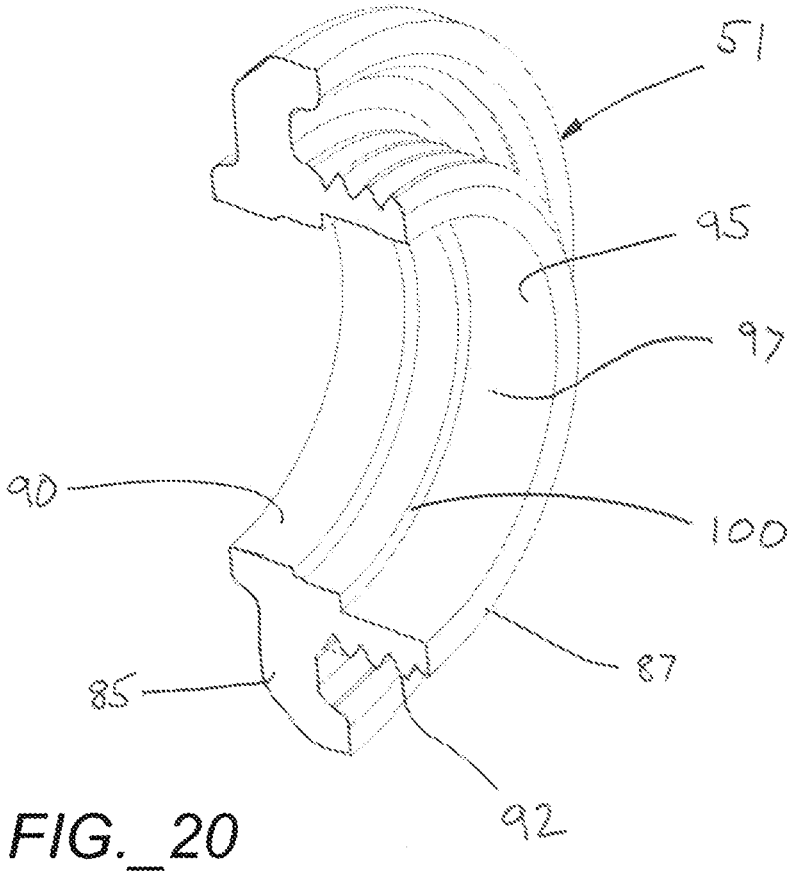
FIG. 20 is an enlarged, bottom perspective view, in cross-section, of the second end cap of the lighted hand tool apparatus of FIG. 1.
Figure 22:
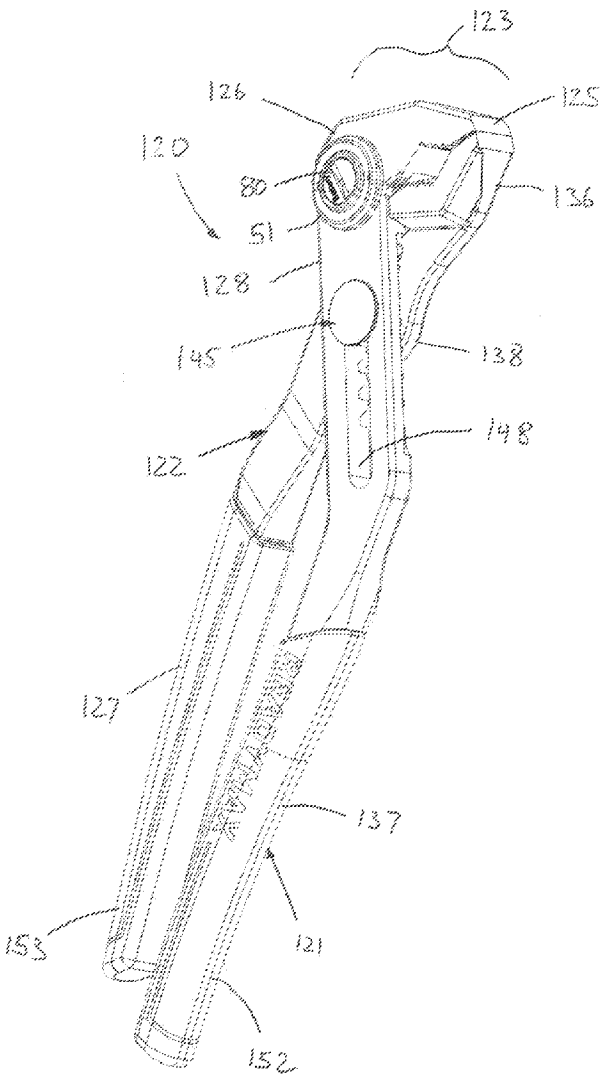
FIG. 22 is an opposite side perspective view of the lighted hand tool apparatus of FIG. 21.
Figure 21:
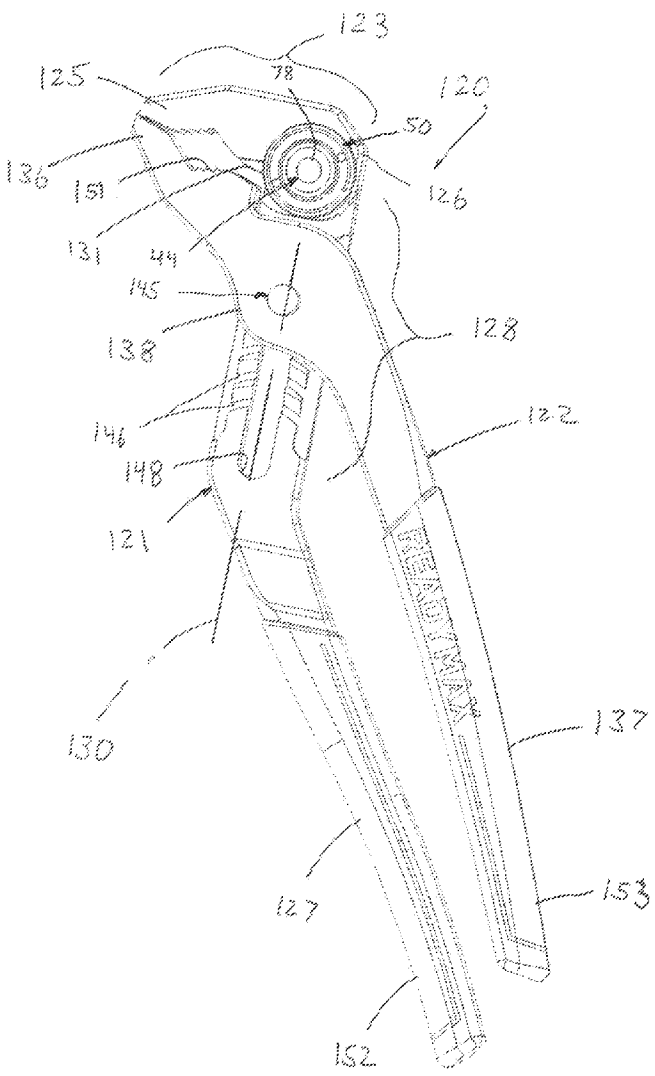
FIG. 21 is a side elevation view of an alternative embodiment lighted hand tool apparatus constructed in accordance with the present invention, illustrated in a closed condition.

As best shown in FIGS. 18-20, each end cap 50, 51 is primarily comprised of a cover disk 83, 85, each having a downwardly depending, annular contact wall 86, 87. The first end cap 50 defines a central button port 88 formed and dimensioned for operable receipt of at least a portion thereof therethrough. Similarly, the second end cap 51 includes a battery cover access port 90 formed and dimensioned to for accessible receipt of the battery cover 80 therethrough. Each annular contact wall 86, 87 includes an exterior facing wall 91, 92 sized and dimensioned for threaded engagement with the respective threaded interior wall 23 of the rivet member 21, and each having an interior facing wall 93, 95 that define a respective receiving recess 96, 97.

At the bottom of each respective recess 96, 97 is a respective annular contact shoulder 98, 100. The annular contact shoulder 98 of the first end cap 50 surrounds, and at least partially defines, the button port 88. Similarly, the annular contact shoulder 100 of the second end cap 51 surrounds, and at least partially defines, the battery cover access port 90.

Each receiving recess 96, 97 is formed and dimensioned for sliding axial receipt of the corresponding ends of the illumination device housing 49 therein. Thus, the head portion 81 of the push button 78 passes through the button port 88 generally until the annular contact shoulder 98 cooperates with, or abuts against, one end of the illumination device housing 49 (FIGS. 5, 18 and 19). Similarly, the battery cover 80 of the illumination device 47 passes through the corresponding cover port 90 generally until the annular contact shoulder 100 of the second end cap cooperates with, or abuts against, the opposite end of the illumination device housing 49 (FIGS. 5, 18 and 20).

The axial length, shape and diametric dimensions of the illumination housing 49 are such that when the first end cap 50 is fully threaded into the first opening 26 of the rivet receiving channel 25, an annular underside flange 101 of the respective cover disk 83 abuts against the corresponding outer facing wall 56 of the pivot portion 37, and the annular contact shoulder 98 of the first end cap 50 also generally simultaneously cooperates with, or abuts against, the one end of the illumination device housing 49 (FIGS. 5, 18 and 19). Again, similarly, when the second end cap 51 is fully threaded into the second opening 27 of the receiving channel 25, an annular underside flange 102 of respective disk portion 85 abuts against the corresponding outer facing wall 57 of the pivot portion 38, and the corresponding annular contact shoulder 100 thereof cooperates with, or abuts against, opposite end of the illumination device housing 49 (FIGS. 5, 18 and 20). Collectively, when both end caps are fully threaded into the corresponding hand tool members, the illumination device 47 is secured and sandwiched therebetween.

In one specific embodiment, at the second end cap 51, an annular gasket or O-ring seal 103 can be provided to extend around the opposite end portion of the illumination housing 49. As best shown in FIGS. 5 and 15, the gasket 103 may be sandwiched between the annular contact shoulder 100 in the second end cap receiving recess 97 and the battery cover end of the illumination device housing 49. When the second end cap 51 is fully threaded into the receiving channel 25 of the rivet member, a moisture resistant barrier is formed.

At the first end cap push button end, the seating collar 82 of the push button 78 itself is utilized to form a moisture barrier therewith. FIGS. 5, 18 and 19 best illustrate that the button access port 88 is hour glass-shaped from a cross-sectional side view. As can be seen, the button port tapers radially inward from the exterior surface of the cover disk 83 towards the center thereof. Similarly, from the interior surface of the receiving recess 96, the button access port tapers radially inward towards the center thereof, both tapers of which terminate to slideable receive the head portion 81 of the push button 78. When the first end cap 50 is fully threaded into the receiving channel 25 of the rivet member 21, the resilient seating collar is sandwiched between the tapered interior surface and the first end cap 50 and an annular button receiving flange 105 of the one end of the illumination housing 49.

Figure 26:
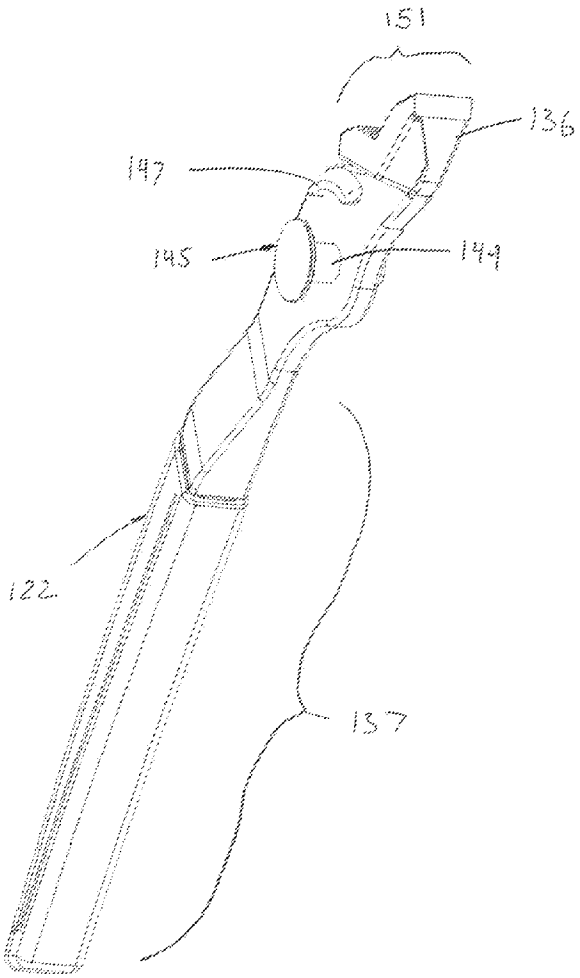
FIG. 26 is an opposite side perspective view of a second tool member of the lighted hand tool apparatus of FIG. 21.
Figure 28:
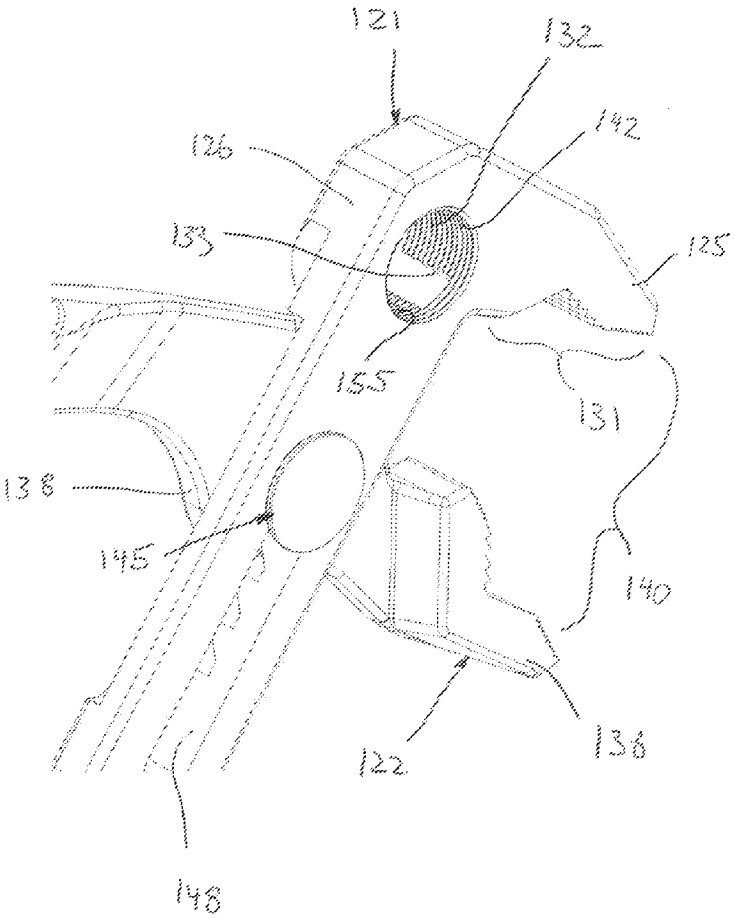
FIG. 28 is an opposite rear perspective view of the lighted hand tool apparatus of FIG. 27.
Figure 27:
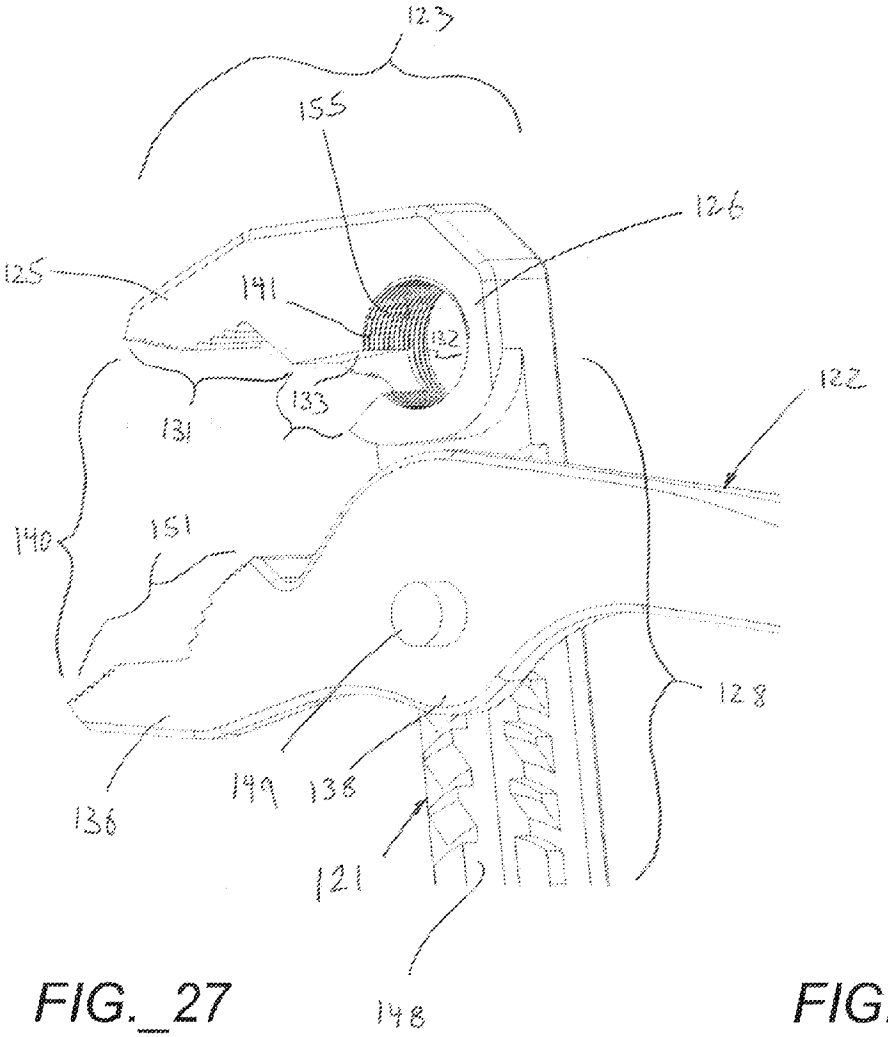
FIG. 27 is an enlarged, fragmentary, rear perspective view of the lighted hand tool apparatus of FIG. 21, without the illumination device.

Turning now to FIGS. 21-28, an alternative embodiment illuminated hand tool apparatus is provided, generally designated 120. This lighted hand tool apparatus 120 includes a first tool member 121 and a second tool member 122, both similarly mounted in a cross-jaw configuration. The first tool member 121 includes a head portion 123 having a first jaw section 125 and an interface section 126. The first tool member 121 further includes a first handle portion 127 and an elongate interlock portion 128 that integrally connects the handle portion 127 to the head portion 123. The elongate interlock portion 128 includes a longitudinal axis 130 and angularly intersects a work surface 131 of the first jaw section 125 at the head portion interface section 126. The interface section 126 further defines a receiving channel 132 extending laterally therethrough from one side of the interface section to an opposite thereof. FIGS. 27, 28 best show that the head portion further defines a communication channel 133 that extends radially from the receiving channel 132 to an end port 135, terminating at the work surface 131 for light communication therebetween. The second tool member 122 similarly includes a second jaw portion 136, a second handle portion 137 and a coupling portion 138 integral between the second jaw portion 136 and the second handle portion 137. The coupling portion 138 cooperates with the elongate interlock portion 128 to movably couple the second tool member 122 to the first tool member 121 in a crossed orientation such that the first and second jaw portions 125, 136 are offset to one side of the longitudinal axis 130 of the elongated interlock portion. The coupling portion 138 is further manually movable along the longitudinal axis 130 of the elongated interlock portion 128 to adjust the size of the work area 140 defined between the first and second jaw portions.

An illumination device 47, similar to that disclosed above, is included having the illumination output portion 48 that outputs a direct light beam therefrom. The illumination device 47 includes the housing 49 that is formed and dimensioned for removable, axial sliding receipt in the receiving channel 132 of the interface section 126 such that the output portion is aligned with the communication channel 133. The illuminated hand tool apparatus 120 further includes a first end cap 50 disposed in a first opening 141 into receiving channel 132, and a second end cap 51 disposed in an opposite second opening 142 into the receiving channel 132. The first end cap and the second end cap cooperate to securely abut and seat the illumination device therebetween.

Figure 24:
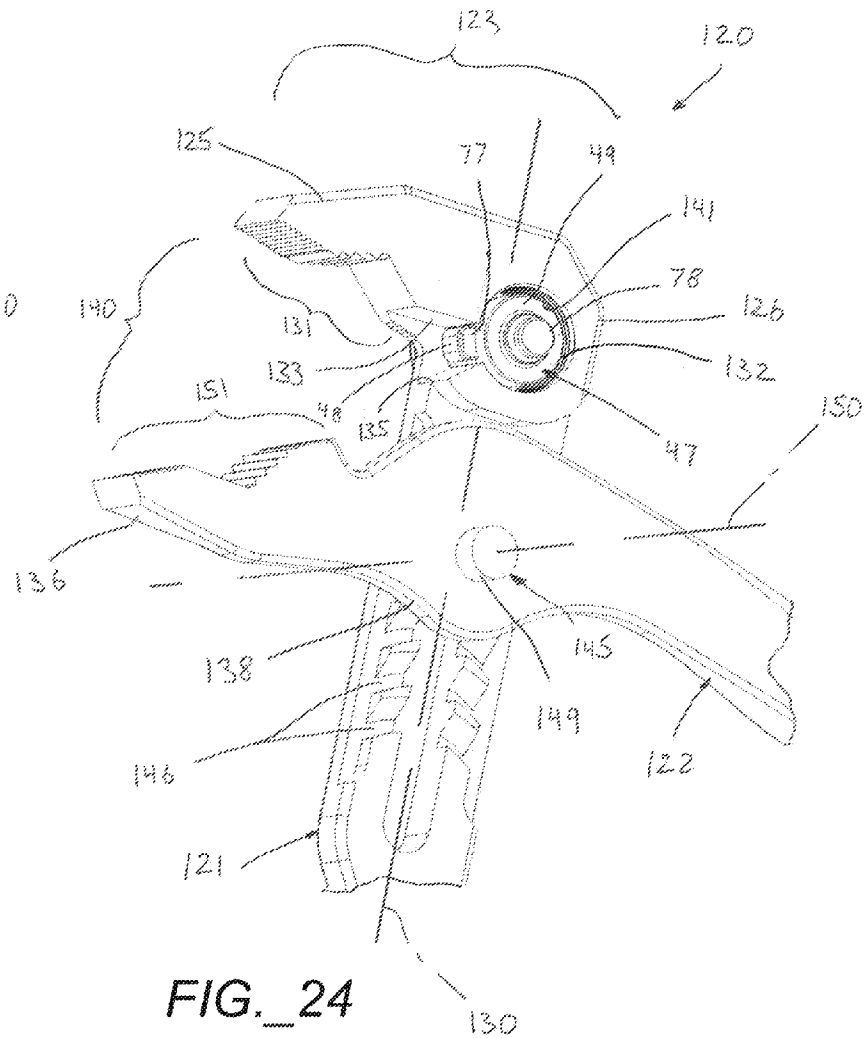
FIG. 24 is a side perspective view of the lighted hand tool apparatus of FIG. 23.
Figure 23:
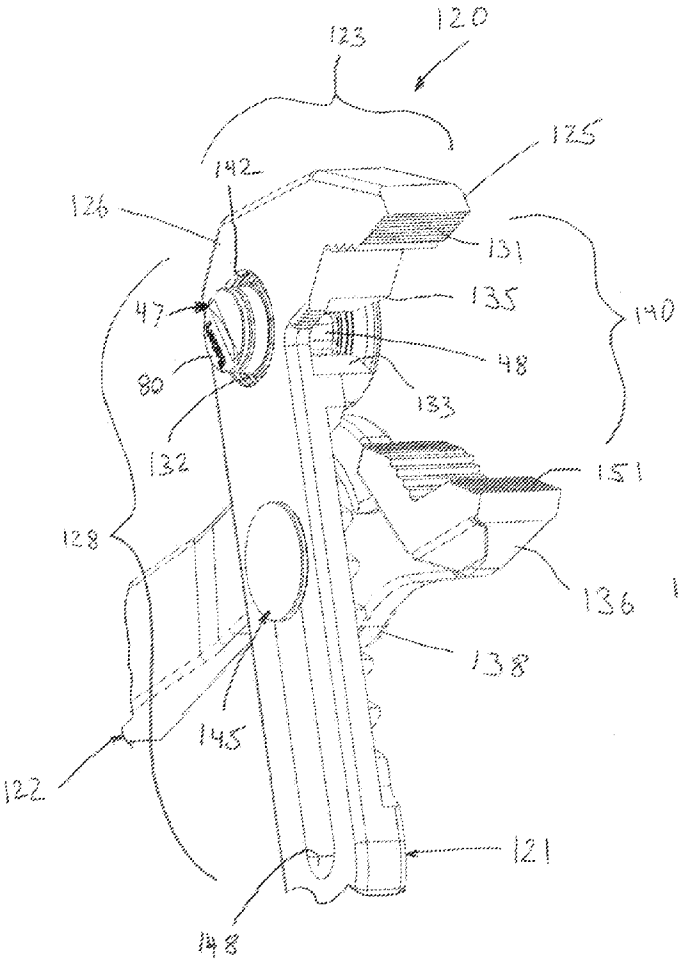
FIG. 23 is an enlarged, fragmentary, front perspective view of the lighted hand tool apparatus of FIG. 21, in an opened condition.

Accordingly, as best shown in FIGS. 23 and 24, a tongue and groove-style plier device is provided that similarly houses an illumination device capable of illuminating the work area. Briefly, tongue & groove pliers are a type of slip-joint pliers that have a large mouth size. The jaws on these pliers can open to multiple widths by moving, or slipping, the pivot into corresponding grooves 146. It will be appreciated, however, that this aspect of the present invention can be used in other hand operated tools of this shape such as a pipe wrench.

Referring back to FIGS. 25-28, as mentioned, a conventional tongue and groove plier hand tool apparatus 120 is shown having the first tool member 121 and the second tool member 122 pivotally joined at the coupling portion 138 and the interlock portion 128, by a nut assembly 145. Briefly, one side of the interlock portion 128 includes a plurality of conventional arcuate grooves 146 spaced-apart along the longitudinal axis 130 thereof, as well as an elongated slot 148, also extending along the direction of the axis. In contrast, the opposed engaging side of the coupling portion 138 includes an arcuate tongue portion 147 formed and dimensioned for sliding receiving in one of the mating grooves, when aligned therewith (FIG. 26).

The nut assembly 145 includes a bolt 149 having a shaft that traverses the elongated slot, allowing the second tool member 122 to rotate about the rotational axis 150 of the bolt 149. This assembly, similar to all tongue and groove designs, also allow the second tool member 122 to slide longitudinally along the slot 148 when the arcuate tongue portion 147 of the coupling portion 138 is sufficiently rotated about the rotational axis 150, out of engagement with the arcuate grooves 146.

Similar to the previous embodiment each hand tool member 121, 122, is preferably comprised of a metallic material, for strength purposes, and is more preferably comprised of stainless steel. It will be appreciated, however, that the hand tools may be composed of other lightweight, synthetic or exotic materials. Also, similar to the previous embodiment, each of the first jaw section 125 and the second jaw section 125 includes an opposed corresponding work surface 131, 151 that collectively define the work area 140 when the hand tool members 121, 122 are operationally interconnected about the nut assembly 145. While the shape and of the work surfaces 131, 151 are shown as being relatively rectangular and substantially planar, these dimensions may be varied, and the work surfaces may be conventionally teethed, kneeled or ridged to promote frictional gripping.

Figure 25:
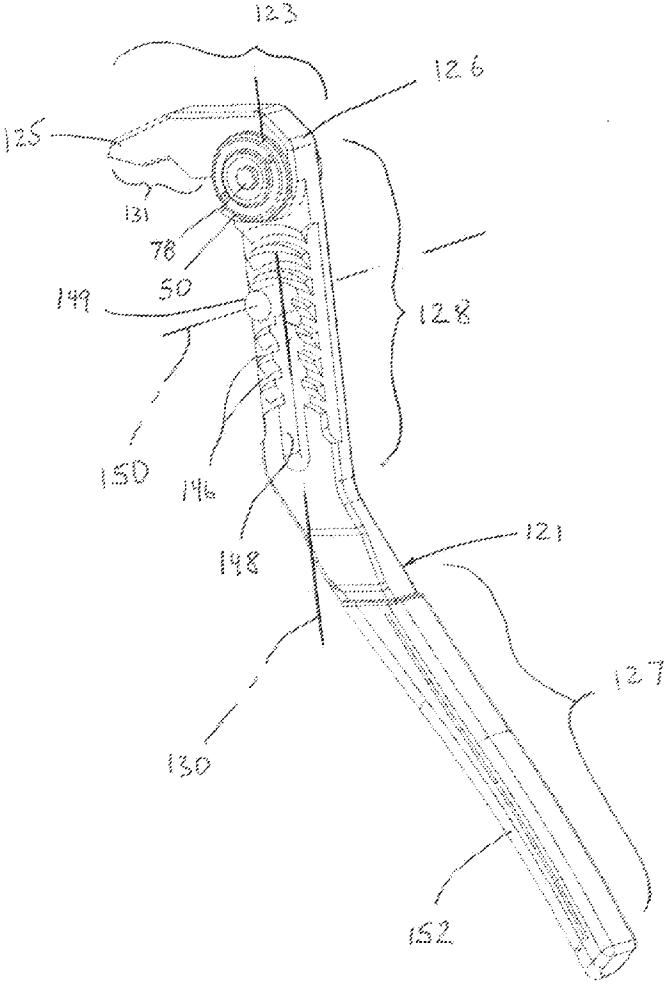
FIG. 25 is a side perspective view of a first tool member of the lighted hand tool apparatus of FIG. 21.

With respect to the corresponding first and second handle portions 127, 137, each is relatively linear (i.e., FIGS. 25, 26). It will be understood, however, that the handle portions could be curved, as well. Moreover, the handle portions 127, 137 may be knurled or textured to enhance gripping, or may include plastic or rubber sleeves and grips 152, 153, as shown, also to promote gripping and comfort.

Briefly, it will be appreciated that the illumination device utilized in this embodiment of the present invention is substantially the same or identical to the illumination device 47 as shown in FIGS. 14 and 15. Moreover, the first and second end caps 50, 51 of this embodiment are also substantially the same or identical to the those illustrated in FIGS. 13, and 18-20. Accordingly, each of these components will not be described in detail again.

Referring back to FIGS. 27 and 28, the receiving channel 132 of the head portion 123 is oriented generally adjacent the interior corner (interface section 126) of the first tool member 121 where the head portion and the upper distal end of the elongate interlock portion 128 intersect. The diameter of the interior wall 155 is sized and dimensioned for sliding axial receipt of the housing 49 of the illumination device 47 therein. Moreover, as described above and as shown in FIGS. 23 and 24, the communication channel 133 is further formed and dimensioned for sliding axial receipt of an alignment key portion 77 of the illumination device housing 49 therein, aligning the output portion 48 of the illumination device 47 with the work surface 131 of the first tool member. In turn, this prevents rotation of the illumination device 47 within the receiving channel 132.

In one specific configuration, the light communication channel 133 tapers radially outward from the receiving channel thereof to the end port 135, which terminates as the work area 140. This gradual taper facilitates light dispersion so that the light output portion 48 can directly illuminate the workspace between the jaws without substantially any obstruction. In one specific embodiment, the height of the rectangular communication channel, at the proximal opening at the receiving channel 132, may be in the range of about 0.21" to about 0.23", and tapers outward at about a 30 deg angle, relative to a horizontal plane.

In accordance with the present invention, the first and second end caps 50, 51 cooperate with the interior wall 155 of the interface section 126 and the housing 49 of the illumination device 47 to sandwich the same therebetween, securely seating the illumination device in the receiving channel (as mentioned above) Accordingly, the width of the interface section from the one side to the opposite side thereof, together with the illumination device housing 49 dimensions, and the end caps 50, 51 all cooperate for seated interengagement, similar to that mentioned above with the cross-jaw pliers embodiment, when fully assembled Thus, on the first end cap 50 side, the push on/off button 78 of the illumination device 47 will be accessible through the button port 88. Similarly, on the second end cap side, the battery cover 80 will be accessible via the cover access port 90 (FIGS. 13-15).

Preferably, the interior wall 155 of the receiving channel are threaded, and threadably engage the threaded exterior facing walls 91, 92 of the respective contact walls 86, 87 of the first and second end caps 50, 51. It will be appreciated, however, that alternative embodiment the end caps can be removably mounted to the corresponding sides of the interface section 126 by machine screws or the like.

Although only a few embodiments of the present inventions have been described in detail, it should be understood that the present inventions might be embodied in many other specific forms without departing from the spirit or scope of the inventions.

What is claimed is:

1. A lighted hand tool apparatus comprising:

a generally cylindrical-shaped rivet member having an exterior wall and a threaded interior wall defining a receiving channel longitudinally extending from a first opening at one end of the rivet member to a second opening at an opposite end thereof, said rivet member defining a side communication port radially extending into said receiving channel from said exterior wall to said interior wall;

a first tool member and a second tool member each having a respective handle portion, a jaw portion, and an intermediate pivot portion therebetween, each respective pivot portion defining a respective generally cylindrical bore section each extending substantially laterally across the corresponding pivot portions from an inner facing wall to an outer facing wall, said bore section being in co-axial alignment for aligned receipt of the rivet member therein such that in a secured condition, the rivet member prevents lateral separation thereof while simultaneously interconnects the first and second tool member together for relative pivotally movement, about a rotational axis, of the respective jaw portions that collectively define a work area between an opened condition and a closed condition, said side communication port being in communicative alignment with a respective central passageway defined by at least one respective pivot portion and extending from the respective bore section to an end port terminating at the work area to permit communication of the rivet member receiving channel with the work area during operative use;

an illumination device having an illumination output portion outputting a direct light beam therefrom, and having a housing formed and dimensioned for removable, axial sliding receipt in the receiving channel of said rivet member in a manner aligning the output portion with the side communication port to directly illuminate said work area during operative use;

a first end cap threadably disposed in said first opening of said rivet member; and a second end cap threadably disposed in said second opening of said rivet member, said first end cap and said second end cap cooperating to securely abut and seat said illumination device therebetween.

2. The hand tool apparatus according to claim 1, wherein said output portion of the illumination device includes an alignment key portion extending radially outward from said exterior surface of the housing, and generally perpendicular to a longitudinal axis of said illumination device; and said rivet member further defines an alignment slot defined by the threaded interior wall, said alignment slot is formed and dimensioned for sliding receipt of said alignment key portion of the housing as said illumination device is received in said central passage.

3. The hand tool apparatus according to claim 1, wherein said illumination device includes a button assembly on one end of said housing, and said first end cap includes a cover disk portion defining a button port formed for receipt of at least a portion of said button assembly to enable operable access thereof when threadably mounted to the rivet member.

4. The hand tool apparatus according to claim 3, wherein said illumination device includes a battery cover on an opposite end of said housing, and said second end cap includes a cover disk portion defining a battery cover port formed for operable access to said battery cover when threadably mounted to the rivet member.

5. The hand tool apparatus according to claim 4, wherein each said first end cap and said second end cap include respective annular contact walls downwardly depending from an underside of the respective cover disk portion thereof, each respective contact wall having an exterior facing wall configured for threaded engagement with the threaded interior wall of said rivet member, and each having an interior facing wall defining a respective receiving recess formed and dimensioned for respective seated receipt of the one end and the opposite end the housing when both the first end cap and the second end cap are threadably mounted to said rivet member.

6. The hand tool apparatus according to claim 1, wherein each respective bore section of the first and second tool member is defined by a substantially cylindrical interior wall, and each co-axially aligned relative one another, said cylindrical interior wall of said first tool member being sized and dimensioned for press-fit mounting around said exterior wall of said rivet member, fixedly mounting the first tool member to said rivet member, said cylindrical interior wall of said second tool member being sized and dimensioned for snug mounting around said exterior wall of said rivet member, allowing pivotal movement of said second tool member about said rotational axis.

7. The hand tool apparatus according to claim 6, wherein each respective bore section including opposed, outer retaining chamfers tapering radially outwardly from the respective interior wall thereof toward the respective outer facing wall, and the opposed end of said rivet member including annular retaining lips flaring radially outward generally abutting respective retaining chamfers, self-retaining said rivet member between the respective bore sections.

8. The hand tool apparatus according to claim 7, wherein said annular retaining lips are swage formed.

9. The hand tool apparatus according to claim 1, wherein the respective central passageway is generally oriented along a longitudinal axis that is substantially perpendicular said rotational axis.

10. The hand tool apparatus according to claim 9, wherein the respective central passageway generally rectangular prism-shaped.

11. The hand tool apparatus according to claim 1, wherein said hand tool apparatus is one of nippers, cutters, and pliers.

* * * * *